US005701146A

United States Patent [19]

Akiyama et al.

[11] Patent Number: 5,701,146

[45] Date of Patent: Dec. 23, 1997

[54] INK HEAD RECOVERY METHOD AND APPARATUS

[75] Inventors: Yuji Akiyama; Hiromitsu Hirabayashi, both of Yokohama; Shigeyasu Nagoshi; Atsushi Arai, both of Kawasaki; Tetsuji Kurata, Yokohama; Hitoshi Sugimoto, Kawasaki; Miyuki Matsubara, Tokyo, all of Japan

[73] Assignee: Canon Kabushiki Kaisha, Tokyo, Japan

[21] Appl. No.: 399,996

[22] Filed: Mar. 6, 1995

Related U.S. Application Data

[63] Continuation of Ser. No. 961,651, Oct. 16, 1992, abandoned.

[30] Foreign Application Priority Data

Oct. 18, 1991 [JP] Japan ..... 3-271027

[51] Int. Cl.[6] ..... B41J 2/165; B41J 2/05

[52] U.S. Cl. ..... 347/26; 347/30; 347/32; 347/35

[58] Field of Search ..... 347/22, 23, 30, 347/32, 31, 35, 26

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/56 X |
| 4,463,359 | 7/1984 | Ayata et al. | 347/56 |
| 4,558,333 | 12/1985 | Sugitani et al. | 347/65 |
| 4,668,965 | 5/1987 | Tanaka et al. | 347/26 |
| 4,723,129 | 2/1988 | Endo et al. | 347/56 |
| 4,740,796 | 4/1988 | Endo et al. | 347/56 |
| 4,825,231 | 4/1989 | Nozaki | 347/30 |
| 4,965,596 | 10/1990 | Nagoshi et al. | 347/36 |
| 4,967,204 | 10/1990 | Terasawa et al. | 347/23 |
| 4,977,459 | 12/1990 | Ebinuma et al. | 347/23 X |
| 5,018,884 | 5/1991 | Hirano et al. | 347/30 |
| 5,055,861 | 10/1991 | Murayama et al. | 347/29 |
| 5,172,140 | 12/1992 | Hirabayashi et al. | 347/36 |
| 5,289,207 | 2/1994 | Ebisawa | 347/23 |

FOREIGN PATENT DOCUMENTS

| | | | |
|---|---|---|---|
| 0471374 | 2/1992 | European Pat. Off. | B41J 2/165 |
| 2843064 | 10/1991 | Germany | B41J 3/04 |
| 59-123670 | 7/1984 | Japan | B41J 3/04 |
| 59-138461 | 8/1984 | Japan | B41J 3/04 |
| 4-141438 | 5/1992 | Japan | B41J 2/165 |
| 2169855 | 7/1986 | United Kingdom | B41J 3/04 |

*Primary Examiner*—Joseph W. Hartary

*Attorney, Agent, or Firm*—Fitzpatrick, Cella, Harper & Scinto

[57] ABSTRACT

An ink jet recording apparatus includes a recording head for performing recording by discharging ink by forming a bubble by applying thermal energy to a heat acting portion of an ink holding portion of the recording head. Thermal energy is generated in the recording head and a cap sealingly caps a discharge opening forming surface of the recording head. Ink is sucked from the cap and positive recovery is effected so that $10^4$ or more times of preliminary discharges are performed toward the cap which is detached from the recording head, by supplying energy greater than energy at a recording condition by predetermined multiples of a minimum energy $E_o$ required for generating the bubble, and for causing the ink to be sucked in the cap that is open to atmosphere.

16 Claims, 12 Drawing Sheets

| |
|---|
| FIG. 12A |
| FIG. 12B |

INK HEAD RECOVERY METHOD AND APPARATUS

This application is a continuation of application Ser. No. 07/961,651 filed Oct. 16, 1992, now abandoned.

BACKGROUND OF THE INVENTION

1. Field of the Invention

The present invention relates to an ink jet recording apparatus such as a printer mountable on or connectable to a copying machine, communication equipment or information equipment, and a method for recovering a recording head used with such equipments. More particularly, the present invention relates to a positive recovery mechanism for systems each having a heat generating element for forming a bubble in ink by generating thermal energy, and a drive circuit for driving such heat generating element by an electric pulse signal.

2. Related Background Art

As disclosed in U.S. Pat. No. 4,740,796 and West German Public Disclosure No. 2843064, fundamental inventions for generating bubbles by utilizing thermal energy are embodied as apparatus wherein heat generating resistance elements are driven by electric pulse signals, or apparatus utilizing optical energy. Further, apparatus having conversion elements for converting optical energy into thermal energy are already known.

In the ink jet recording field, other than a recording operation, a recovery operation, referred to as preliminary discharge, for discharging ink from discharge openings has been performed. A technique in which the preliminary discharge is effected at the proper timing during the recording operation or during a waiting condition is also known, as disclosed in Great Britain Patent No. 2169855. This patent specification concretely discloses the recovery operation effected as the preliminary discharge during the normal recording operation.

On the other hand, a recovery operation using a pump, normally referred to as absorb recovery, for recovering an extremely jammed recording head has been practically used. Also in U.S. Pat. No. 4,977,459 wherein the fact that a proper recovery treatment is effected in accordance with a condition of a recording head is disclosed, the final positive recovery treatment is performed by the absorb recovery, rather than by the preliminary discharge.

Further, since the conventional preliminary discharge was frequently carried out, the discharge condition for the preliminary discharge was the same as or similar to the discharge condition for the normal recording operation, in order to extend the service life of heat generating elements of the recording head. The ink discharged by the preliminary discharge is normally directed to an ink absorber; however, other than the ink absorber, it is known to use an exclusive paper sheet, a recording sheet, a foam body or a cap for capping the recording head as an ink receiving member.

Furthermore, in order to improve the recovery effect of the preliminary discharge, an epochal invention wherein the absorb recovery while closely contacting with a recording head issued together with the preliminary discharge has been proposed, as described in U.S. patent application. Ser. No. 198,733 filed on May 25, 1988 by assignee of the application.

On the other hand, a technique referred to as idle absorb in which, after the absorb is effected while a cap is being closely contacted with a recording head, the interior of the cap is communicated with the atmosphere before the cap is separated from the recording head, or the suction of the interior of the cap is effected after the cap is separated from the recording head is disclosed in U.S. Pat. No. 4,967,204. An object of this patent is to prevent the leakage of ink from the cap.

By the way, in an invention described in U.S. patent application. Ser. No. 745 480 now U.S. Pat. No. 5,289,207 which was filed on Aug. 14, 1991 by assignee of this application prior to the priority date (Oct. 18, 1991) of this application, there has been proposed a recovery treatment which can solve problems regarding the adhesion of foreign matters to discharge elements of thermal energy generating type for a long term non-operation of the recording head and/or the variation in the fluidity of ink due to the difference in the frequency of use of individual discharge openings. A typical embodiment of the invention relates to a recovery method wherein the ink is discharged onto a recording medium or into a cap and which includes a positive recovery mode for effecting $10^3$ or more preliminary discharges by supplying the energy smaller than the minimum energy $E_0$ required to generate the film boiling and greater than the energy required to effect the normal discharge.

The inventors of this invention aimed or assumed to eliminate the waste of the recording media in carrying out the positive recovery mode in the above-mentioned recovery method. Now, since it was found that there was a great amount of discharged ink and the discharged ink was rebounded, the cap was closely contacted with the recording head during the preliminary discharge. However, when done, the surface of the recording head was covered by a large amount of ink. As a result, it was impossible to discharge the ink stably, and further, it was difficult to clean the surface of the recording head (that is, the ink could not be removed from the surface of the recording head completely by the normal cleaning method, thus still remaining the ink on the head surface). When the recording operation was effected in this condition, the recording ink discharges were distorted or disordered. Accordingly, in the aimed arrangement, although the recovery of the interior (discharge openings) of the recording head could be attained, a new problem regarding the recovery of the surface of the recording head arose, and thus, the satisfactory recovery effect could not be achieved.

Further, it was found that, when the abovementioned positive recovery mode was effected by a color recording means, a large amount of ink exceeding the ink absorbing ability of the recording medium was discharged, thus causing the contamination of internal parts of the recording apparatus due to the poor fixing and/or the mixing of colors during the cleaning operation by a cleaning blade.

From another point of view, the inventors found that the ability for receiving a large amount of ink from the preliminary discharge was reduced due to the change in position of the cap, thus causing a problem regarding the leakage of ink.

SUMMARY OF THE INVENTION

A main object of the present invention is to provide a recovery method and apparatus which can eliminate the inconvenience regarding the interior of a recording head and a surface of the head by effecting the idle absorb with respect to a cap separated from the recording head and by varying the energy applied to an acting zone (in an ink holding area) on which the thermal energy acts in a case where the positive recovery rather than the normal recovery is required.

Another object of the present invention is to provide a positive recovery preliminary discharge mode which can carry out the above-mentioned recovery method more surely and efficiently.

A further object of the present invention is to provide a reasonable recovery method and apparatus which can previously perform a process for further increasing a temperature adjust setting temperature at a recording operation of a recording head in order to improve the recovery effect of the ink discharge by the positive recovery preliminary discharge mode and can extend the service life.

A still further object of the present invention is to provide an effective recovery sequence wherein a process for mechanically adjusting a position of a cap (used in a condition that it is separated from a recording head) with respect to the recording head is performed before the positive recovery preliminary discharge (Preferably, the mechanical positional adjustment is effected per each absorb process).

According to a preferred aspect of the present invention, there is provided an ink head recovery method comprising a pre-process for setting the temperature adjust setting temperature at a recording operation of a recording head to be recovery more than 60° C., for preventing the vaporization of bubbles in the ink and for effecting the absorb of ink by an amount more than the normal one in order to surely fill the interior of a recording means with ink, and a flashing recovery process for effecting $10^4$ or more preliminary discharges by supplying the energy greater than that required for the normal recording operation to the recording means, for mechanically setting the relative position between the separated recording head and cap and for effecting the idle absorb.

The other object of the present invention is to provide a color recording apparatus having a plurality of recording heads and capable of carrying out a flashing recovery process while preventing the mixing of colors between heads.

A typical ink jet recording apparatus according to the present invention comprises recording means for performing the recording by discharging ink from it by forming a bubble by applying thermal energy to a heat acting portion of an ink holding area; energy supplying means for generating the thermal energy in the recording means; capping means for sealingly capping a discharge opening forming surface of the recording means; absorbing means for absorbing ink from the capping means; and positive recovery means for effecting $10_4$ or more preliminary discharges regarding the capping means separated from the recording means by supplying energy greater than the energy at a recording condition greater than the minimum energy $E_0$ required for generating the bubble by predetermined multiples and for causing the absorbing means to absorb the ink from the interior of a cap of the capping means at an atmosphere. According to the present invention, it is possible to apply the effect of the positive recovery to the recording sufficiently and to eliminate the inconvenience regarding the cap closely contacted with a recording head of the recording means without requiring a recording sheet for receiving the ink discharged by the preliminary discharge.

DETAILED DESCRIPTION OF THE PREFERRED EMBODIMENTS

The present invention will now be fully explained with reference to the accompanying drawings.

Figure 1:
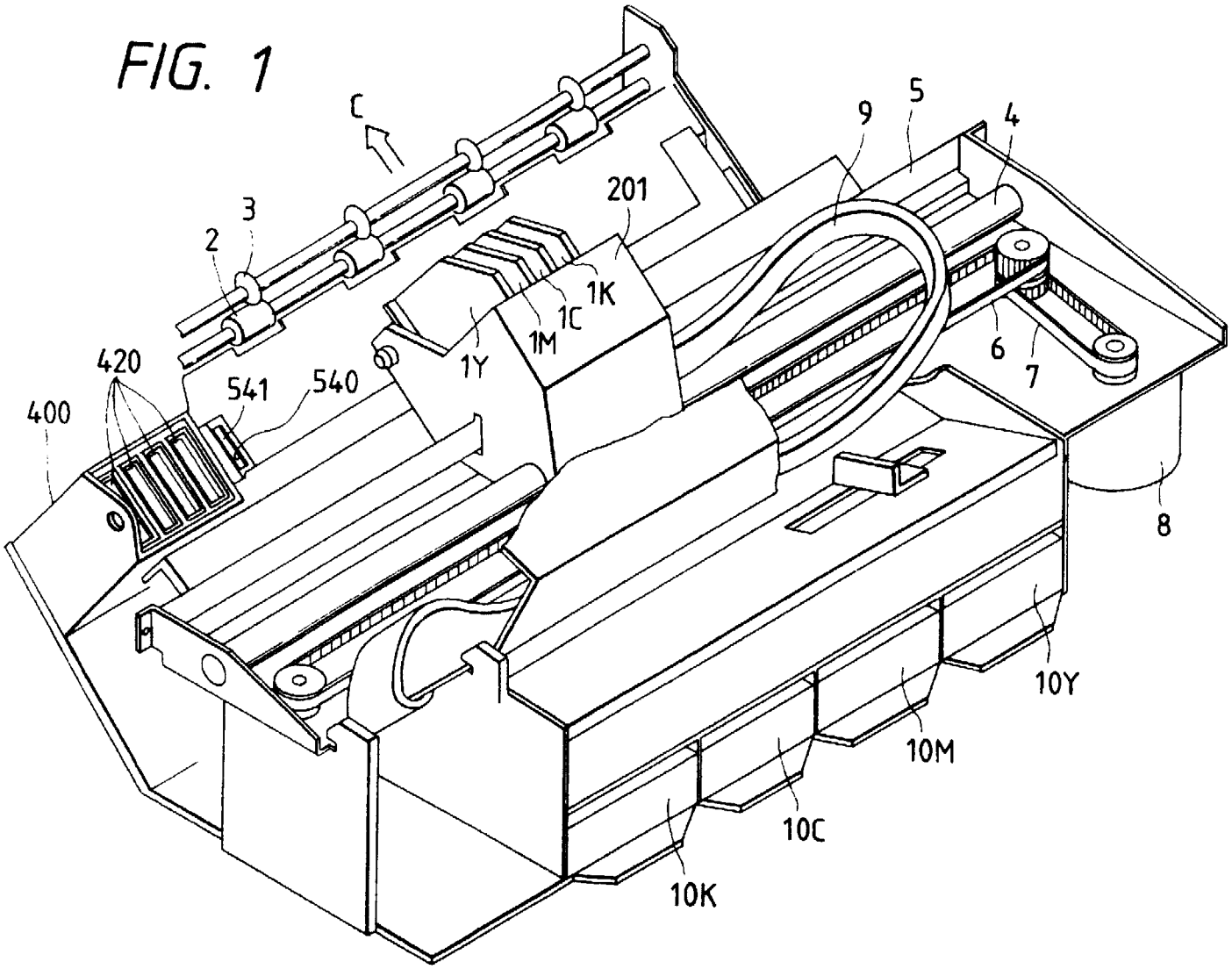
FIG. 1 is a schematic perspective view of a color ink jet recording apparatus of serial scan type according to a preferred embodiment of the present invention.

FIG. 1 is a perspective view showing a main construction of a color ink jet recording apparatus of serial scan type according to a preferred embodiment of the present invention. In FIG. 1, a recording head 1Y for discharging yellow color ink, a recording head 1M for discharging magenta color ink, a recording head 1C for discharging cyan color ink, and a recording head 1K for discharging black color ink are arranged on a carriage 201 and are spaced apart from each other at a predetermined interval. A recording sheet which may comprise a paper sheet or a thin plastic film is fed by feed rollers (not shown) and is pinched between ejector rollers 2, 3, and is fed in a direction shown by the arrow C by driving a feed motor (not shown).

The carriage 201 is supported and guided by a guide shaft 4 and an encoder 5. The carriage 201 is reciprocally shifted along the guide shaft 4 by a carriage motor 8 via drive belts 6, 7. A plurality of discharge openings are formed in a surface (discharge opening forming surface) of each recording head 1 opposed to the recording sheet, and a heat generating element (electrical/thermal energy conversion body) for generating thermal energy used for discharging ink is provided within the interior (liquid passage) of each discharge opening.

In accordance with the reading timing of the encoder 5, the heat generating elements are energized in response to record signals, so that the black, cyan, magenta and yellow ink droplets are successively flown in order onto the recording sheet, thereby forming an image on the recording sheet.

At a home position defined at a predetermined position outside of a recording area, there is arranged a recovery unit 400 having a cap portion 420 including four caps which will be described later. In an inoperative condition (i.e., non-recording condition), the carriage 201 is shifted to the home position so that the discharge opening forming surfaces of the recording heads 1 are sealingly converted by the corresponding caps of the cap portion 420, thereby preventing the solidification of ink due to the vaporization of ink solvent and the jamming of the discharge openings due to the adhesion of foreign matters such as dirt to the discharge openings.

Further, a capping mechanism such as the cap portion 420 is utilized to effect the idle discharge for discharging the ink into the cap portion 420 separated from the discharge openings in order to remove the poor discharge and/or the jamming of the discharge openings of the recording heads 1 having the low frequency of use and is also utilized to effect the discharge recovery of the discharge openings having the poor discharge by sucking or absorbing the ink from such discharge openings by driving a pump (not shown) while capping the discharge openings by the caps.

A blade 540 and a scrape member 541 which are used in a sequence described later are arranged adjacent to the cap portion 420 and serve to clean the discharge opening forming surfaces of the recording heads 1. The ink is supplied to each recording head 1 from a corresponding ink tank 10 via a sub-tank (not shown) mounted on the carriage 201 and an ink supply tube 9.

Next, the operation of elements of the recovery unit 400 will be explained with reference to FIG. 2.

Figure 2:
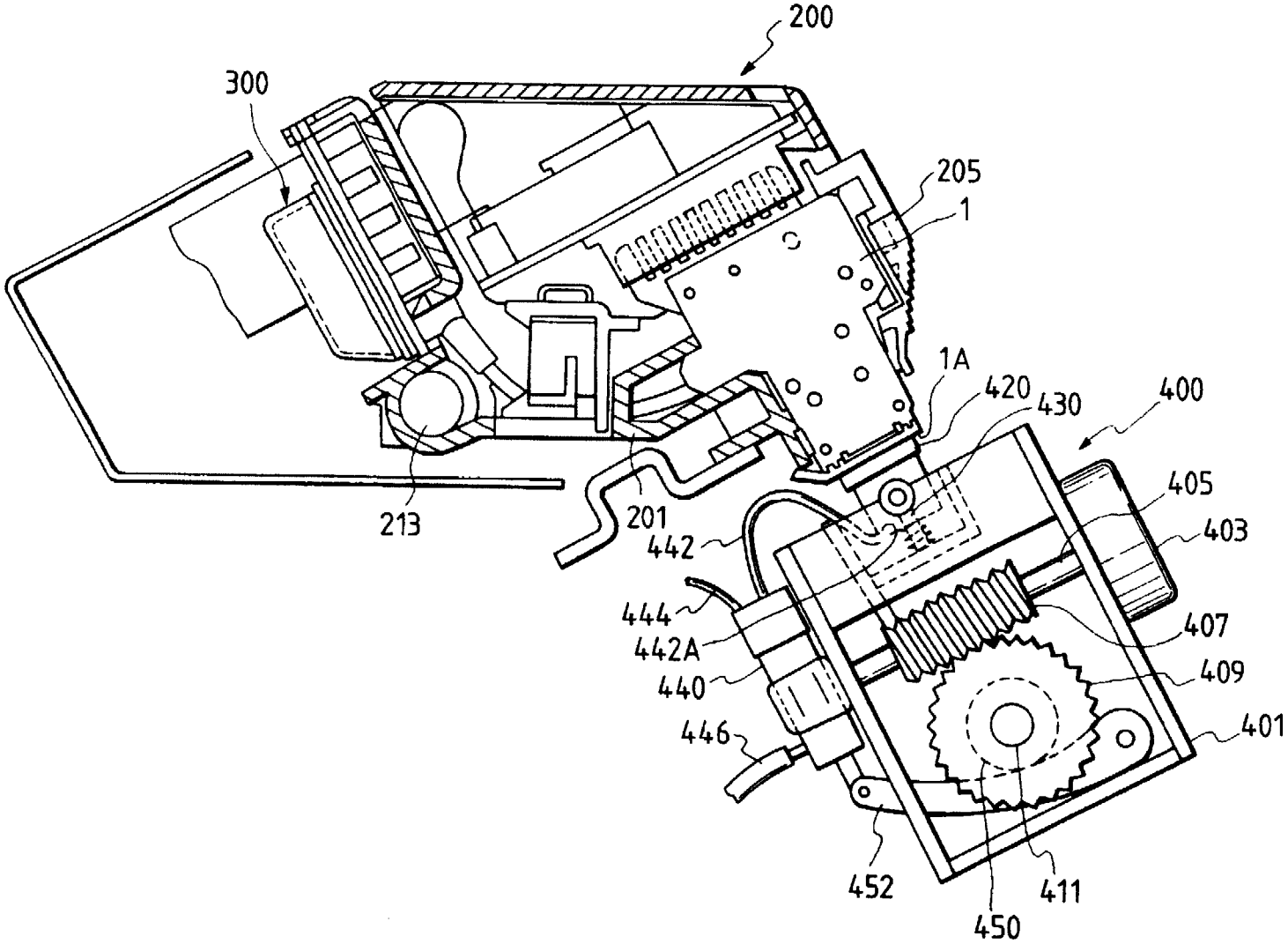
FIG. 2 is a schematic sectional view of a recovery unit of the apparatus of FIG. 1.

In FIG. 2, a unit housing 401 holds thereon a motor (drive source) 403 for driving various elements in the unit, which motor can transmit a driving force to a worm wheel shaft 411 via a worm 407 secured to a motor output shaft 405 and a worm wheel 409 meshed with the worm 407.

The cap portion 420 can abut against the discharge opening forming surfaces 1A of the recording heads 1 to cover the discharge openings and therearound and has an abutment portion made of elastic material such as rubber which are to be abutted against the discharge opening forming surfaces 1A. A cap abutting and equalizing portion 430 serves to abut the caps 420A of the cap portion 420 against the corresponding discharge opening forming surfaces 1A of the recording heads 1 and for keeping the caps in close contact with the corresponding recording heads. A pump 440 serves to apply suction forces to sub-tanks 300 mounted on the carriage 201 via suction tubes 444 to supply the ink to suction tubes 442 communicated with the corresponding caps 420A of the cap portion 420 and to the recording heads 1 and to discharge the sucked ink toward a waste ink absorbing body in a waste ink tank (not shown) via a waste ink tube 446. The pump 440 is driven by a pump drive cam 450 secured to the worm wheel shaft 411 and a pump drive lever 452 engaged by the cam.

In the illustrated embodiment, the tubes 442 communicating the caps 420A of the cap portion 420 with the pump 440 are bent vertically and upwardly from communication ports 442A of the caps to which the tubes 442 are connected, and then are connected to the pump 440 arranged below. With this arrangement, in a capping condition that the recording heads 1 are closely contacted with the corresponding caps 420A, after the ink is absorbed from the discharge openings via the cap portion 420, if the absorb treatment (idle absorb) is not performed or insufficiently performed in a noncapping condition (i.e., a condition that the free ends of the caps 420A are spaced apart from the discharge opening forming surfaces by 2 mm or more, preferably 5 mm), a small amount of ink will remain in the tubes 442, because at least a portion of ink does not flow into the pump due to the existence of the bent portion of the tube 442. By utilizing this phenomenon, it is possible to keep the discharge opening forming surfaces 1A in a wetted state during the capping condition, for example, at the interruption of the recording operation or at the inoperative condition of the apparatus thereby protecting the discharge opening from drying to prevent the jamming of the discharge openings and the like. Thus, it is possible to eliminate or reduce the absorb treatment at the re-starting of the recording operation. Incidentally, when it is desired to keep the recording apparatus in the inoperative condition for a long time or when the power source is turned OFF, the idle absorb sufficient to empty the tubes 442 is effected to prevent the solidification of ink in the tubes.

Further, in the illustrated embodiment, in a condition that the recovery unit 400 is attached to the recording apparatus, the pump 440 is oriented so that the discharge side thereof is directed vertically downwardly and a discharge passage thereof is directed downwardly. With this arrangement, the ink can be smoothly discharged from the pump by the action of the gravity force.

Figure 3A:
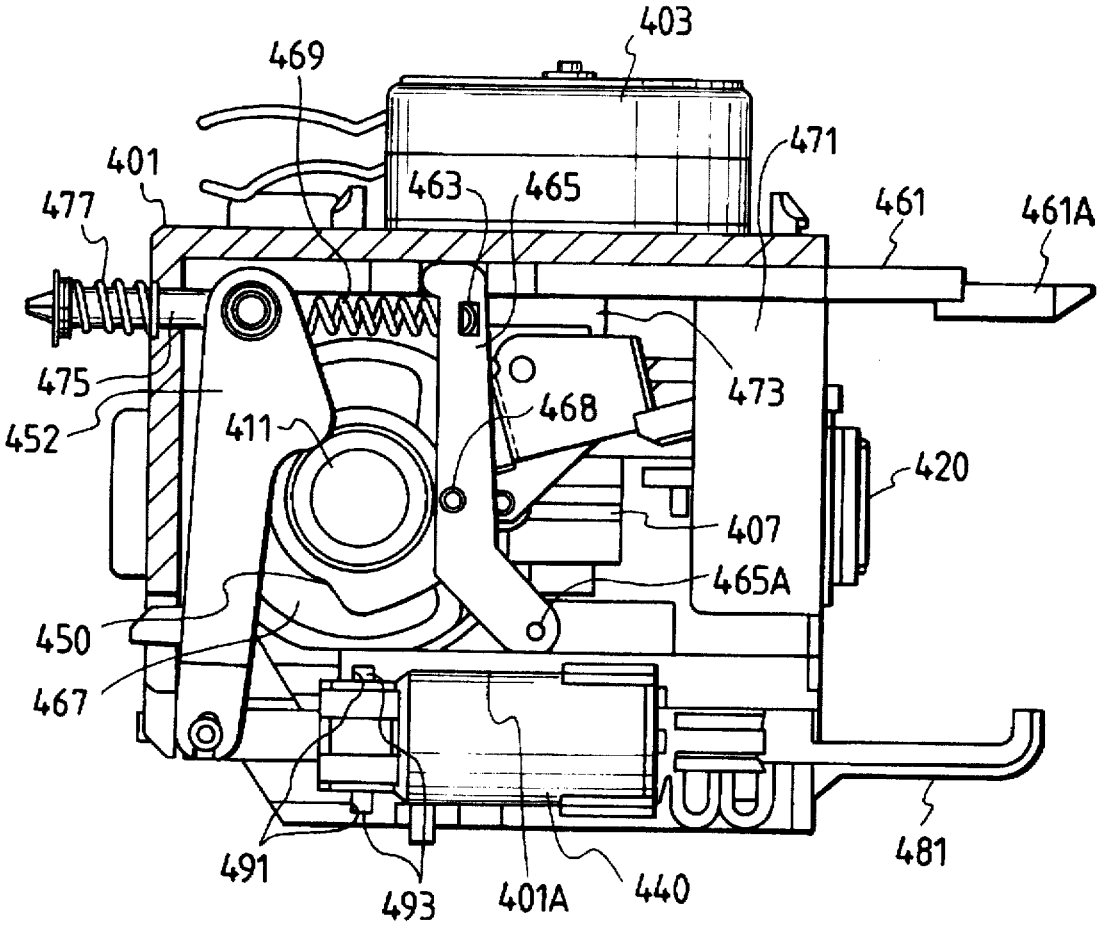
FIG. 3A is a detailed side sectional view of the recovery unit and FIG. 3B is an elevational view of a holder portion for a pump of the unit.
Figure 3B:
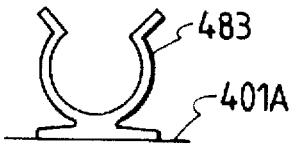

FIGS. 3A and 3B show an embodiment of a positioning means for positioning a relative position between the caps and the corresponding recording heads by utilizing the mechanical engagement so that the caps are correctly in a confronting relation to the corresponding recording heads while being spaced apart from the latter. However, the present invention is not limited to this embodiment, but the positioning means may comprise a lever extending from the recording head or the relative position between the caps and the recording heads may be determined by slightly shifting either the recording heads or the caps with respect to the other so that the caps are correctly in a confronting relation to the corresponding recording heads. Further, an engagement portion may be provided on the capping means rather than the recording means so that the caps and the recording heads are properly positioned.

FIG. 3A is a side sectional view of the recovery unit 400. An access lever 461 serves to correctly confront the cap portion 420 to the discharge opening forming surfaces 1A by inserting a free end portion 461A of the lever into a recess formed in a recording head cover 205. To this end, the free end portion 461A can be displaced or shifted at least in a recording head scanning direction (perpendicular to the plane of FIG. 3A). An access lever drive arm 465 is connected to the access lever 461 and is pivotable around a pivot pin 465A disposed near one end of the arm. A cam 467 is secured to the shaft 411, and a pin 468 formed on the arm 465 is abutted against the cam. A coil spring 469 is connected between the housing 401 and a projection 463 formed on the access lever 461 and serves to bias the arm 465 toward the cam 467 so that the pin 468 can follow the profile of the cam 467 to regulate the movement of the arm 465.

A cap holder 471 serves to hold the cap portion 420, and a holder guide lever 473 is integrally formed with the cap holder 471 and has a free end portion 475 extending through a hole formed in the housing 401. The cap holder 471 holding the cap portion 420 can shift toward and away from the recovery unit 400 so that when the cap holder is advanced toward the recovery unit the cap portion 420 is abutted against the discharge opening forming surfaces 1A and when the cap holder is retracted from the recovery unit the cap portion is separated from the discharge opening forming surfaces. Further, the cap holder 471 and accordingly the cap portion 420 can be displaced in the recording head scanning direction. A coil spring 477 is arranged around the free end portion 475 of the holder guide lever so that an engagement portion at the holder side is abutted against a cam for controlling the advancing and retracting movement of the cap holder 471.

The cap portion 420 is provided with vent holes communicated with the atmosphere, which vent holes described later can be opened and closed by a cam 513 and a drive lever 511 which will also be described later. The advancing and retracting mechanism for the cap portion and the advancing and retracting mechanism, as well as the opening/closing mechanism for the vent holes, will be described later with reference to FIGS. 6A to 6C.

In FIG. 3A, the reference numeral 481 denotes a lock portion for interlocking the recovery unit 400 and the carriage 201 during the recovery treatment and the like. The pump 440 is held by a holder member 483 (FIG. 3B) formed on a pump receiving portion 401A of the housing. The holder member 483 has a substantially C-shaped cross-section and serves to hold the pump 440 by its own elastic deformation and restoring force. Incidentally, locking portions 491 formed on the housing and locking portions 493 formed on the pump are used to position the pump 440 and hold it in a mounted position.

Figure 4:
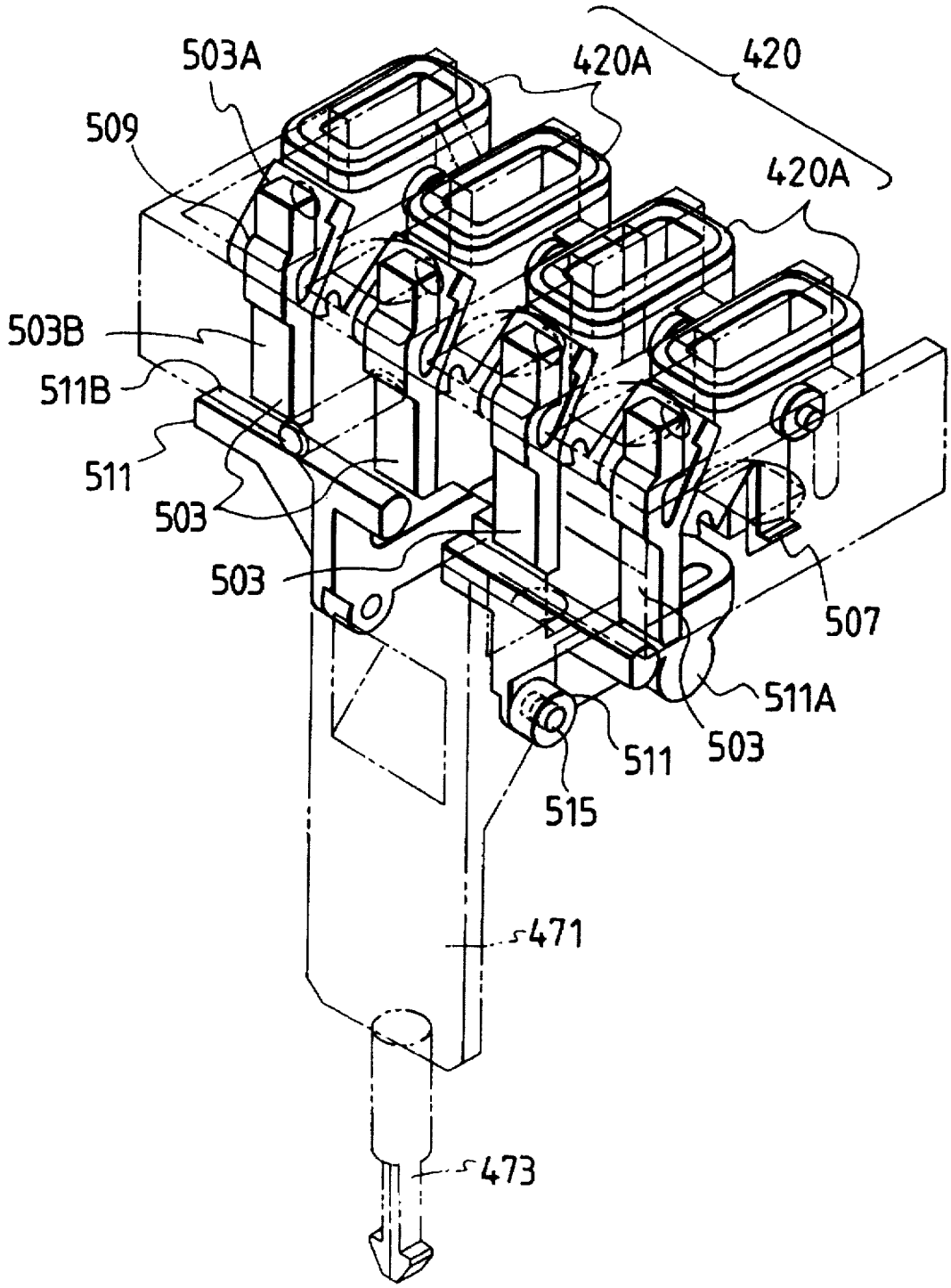
FIG. 4 is a perspective view of the recovery unit showing an opening/closing mechanism for opening and closing vent holes of a cap portion.
Figure 5:
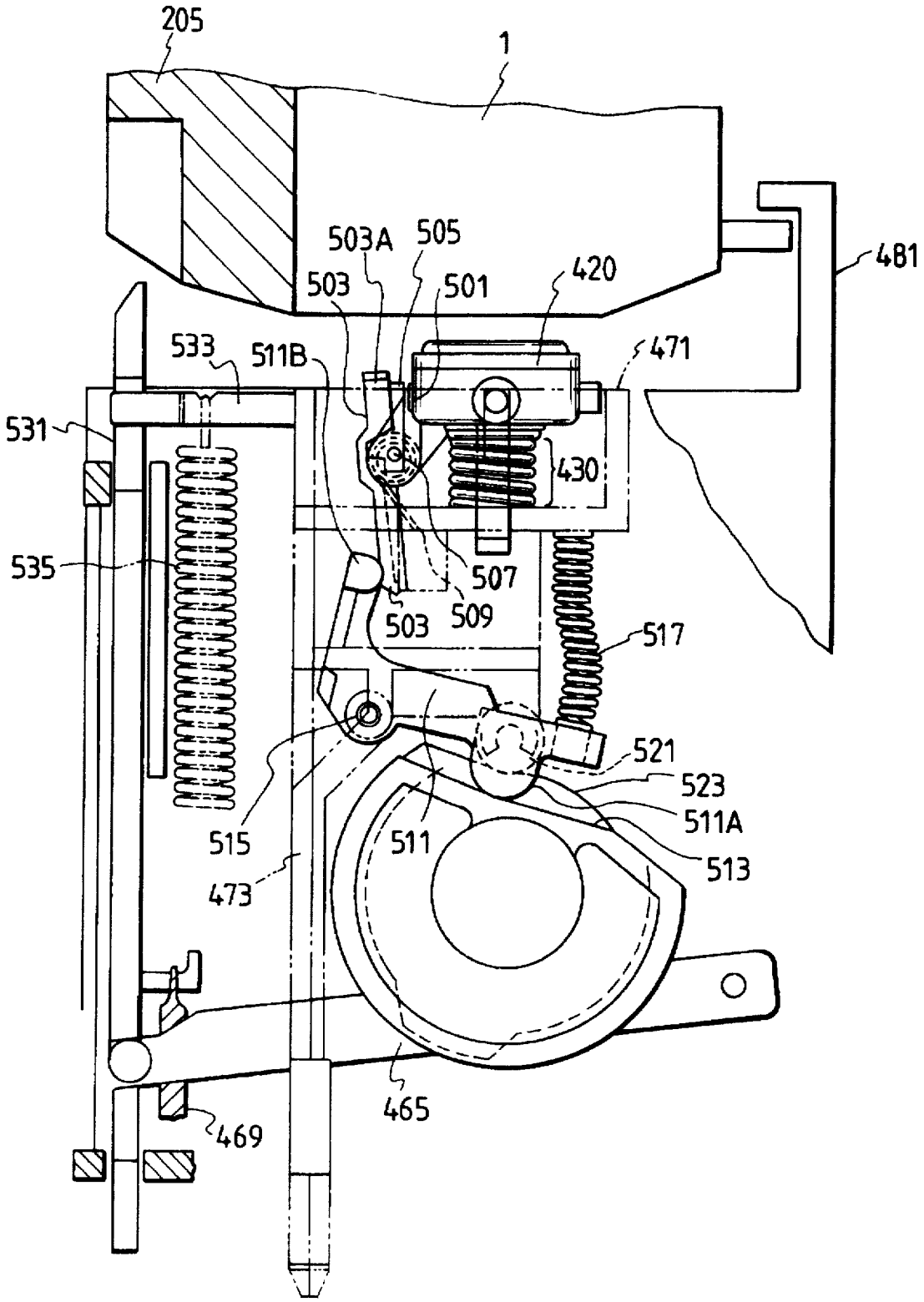
FIG. 5 is a side sectional view of the recovery unit showing the opening/closing mechanism.

FIG. 4 is a perspective view of the recovery unit showing the opening/closing mechanism for the vent holes of the cap portion, and FIG. 5 is a side sectional view showing such opening/closing mechanism, the advancing and retracting mechanism for the cap portion, and the advancing and retracting mechanism for the access lever.

First of all, the opening/closing mechanism for the vent holes will be explained.

In FIGS. 4 and 5, the reference numeral 501 denotes the vent holes of the cap portion 420 communicated with the atmosphere; and 503 denotes opening/closing levers. Each opening/closing lever comprises an arm portion 503A having aped 505 for closing the corresponding vent hole 501, and an arm portion 503B for engaging by the drive lever 511, and is pivotally mounted on a shaft 507. Each opening/closing lever 503 is biased by a spring 509 to close the corresponding vent hole.

The drive lever 511 has a portion 511A engaged by a vent hole opening/closing cam 513 and a portion 511B engaged by the arm portions 503B of the opening/closing levers 503, and is pivotally mounted on a shaft 515. A spring 517 serves to bias the drive lever 511, thereby abutting the portion 511A against the cam 513. With this arrangement, the interior of the cap portion 420 can be communicated with or blocked from the atmosphere in accordance with the movement of the cam 513.

Next, the advancing and retracting mechanism for the cap portion 420 will be explained.

In FIG. 5, the cap holder 471 and the holder guide lever 473 are shown by the two-dot chain line. A roller 521 mounted on the holder guide lever 473 is engaged by a cap advancing and retracting cam 523. A slot 531 is formed in the access lever 461 along its length and receives a pin 533 protruded from the cap holder 471. Thus, in the illustrated embodiment, during the advancing and retracting movement of the cap portion 420, the latter is guided by the slot 531. Further, in the recording head scanning direction, the cap portion is shifted together with the access lever 461.

A coil spring 535 cooperates with the spring 477 to bias the cap portion 420 toward the retracting direction. The reference numeral 205H denotes a recess formed in the recording head cover 205 for receiving the free end portion 461A of the access lever 461. Incidentally, in FIG. 5, the access lever drive arm 465 is shown at a position different from that of FIG. 3 for clarity's sake.

Next, the advancing and retracting movement of the access lever 461 and the cap portion 420 will be explained.

Generally, it is difficult to stop the carriage with high accuracy so that the caps are correctly in a confronting relation to the discharge opening forming surfaces of the recording heads. Thus, for example, the carriage may be positioned so that the recording heads are positively confronted to the caps correctly by inserting a projection formed on the recovery unit into a recessed member formed on the recording head. In the illustrated embodiment, since the four recording heads are mounted on the carriage and the total weight of the heads and carriage is great, not only the greater force is required to forcibly displace the carriage with the recording heads, but also the projection and/or the caps are subjected to the excessive load. Accordingly, in the illustrated embodiment, the cap portion 420 is displaced to correctly confront it to the discharge opening forming surfaces of the recording heads. The structure for achieving such displacement will now be explained with reference to FIGS. 6A to 6C.

Figure 6A:
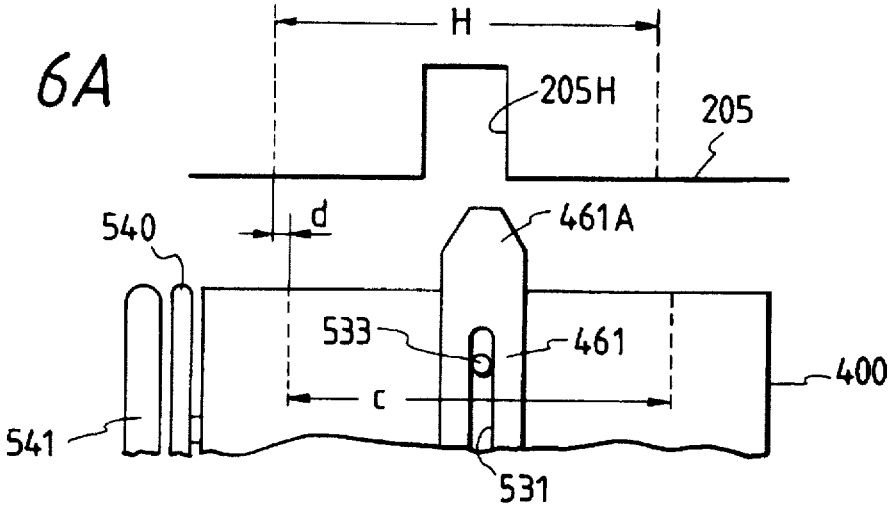
FIGS. 6A to 6C are views for explaining the operation of a cap advancing/retracting mechanism according to the preferred embodiment.

First of all, it is assumed that the carriage is stopped in a position where a range H within which the four recording heads are arranged is deviated from a range C within which the four caps for covering the corresponding discharge opening forming surfaces of the recording heads by a distance d as shown in FIG. 6A (Normally, although the distance d is caused due to the minute unevenness of the carriage drive motor and is minor, when the caps receive a large amount of ink as in the present invention, a new problem regarding the leakage of ink may arise).

Figure 6B:
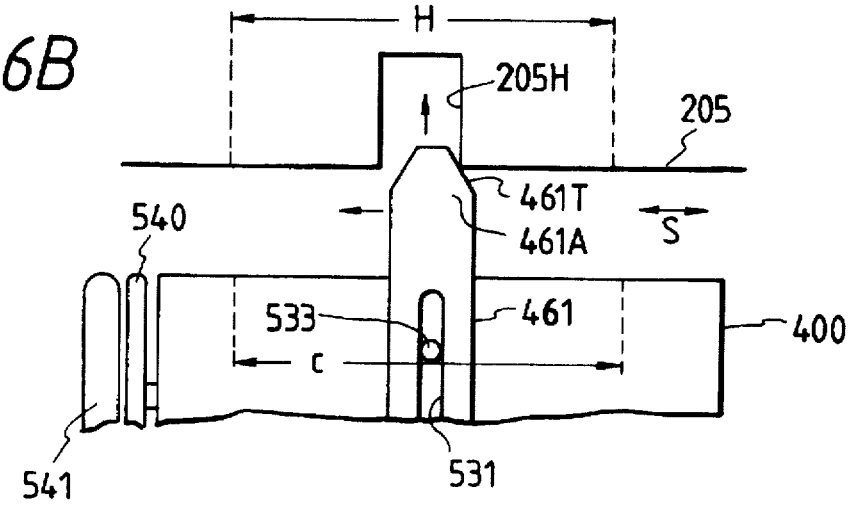

From this condition, as the access lever 461 is extended, a tapered portion 461T of the free end portion 461A of the access lever is engaged by the recess 205H of the head cover 205, with the result that, if the access lever 461 is displaceable in a carriage scanning direction S, as shown in FIG. 6B, the free end portion 461A is entered into the recess 205H while displacing to the left. The left movement of the access lever causes the left movement of the cap holder 471 and accordingly the cap portion 420 since the pin 533 of the cap holder is engaged by the slot 531 of the access lever. After the insertion of the free end portion 461A of the access lever into the recess 205H has been completed (FIG. 6C), since the deviation between the range H and the range C is eliminated, i.e., the cap portion 420 is correctly opposed to the recording heads when the cap portion 420 is advanced, the correct capping is achieved.

In the illustrated embodiment, the access lever can be inserted into the recess without requiring the severe accuracy regarding the control of the stop position of the carriage, so long as the accuracy to some extent is established.

Figure 6C:
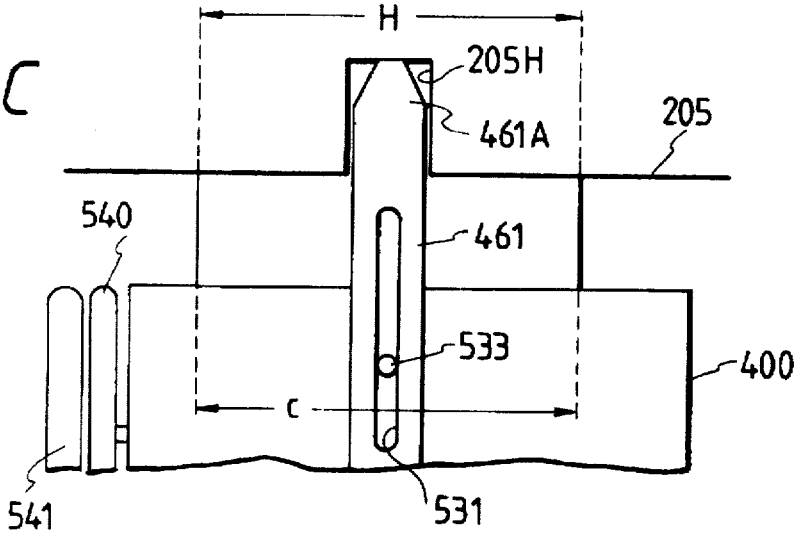

In FIGS. 6A to 6C, the blade 540 and the scrape member 541 can also be advanced and retracted by a cam provided in the recovery unit 400, similar to the above-mentioned elements, so that when the blade and the scrape member are advanced or protruded they are engaged by the discharge opening forming surfaces of the recording heads to clean the latter in response to the scanning movement of the carriage.

Figure 7A:
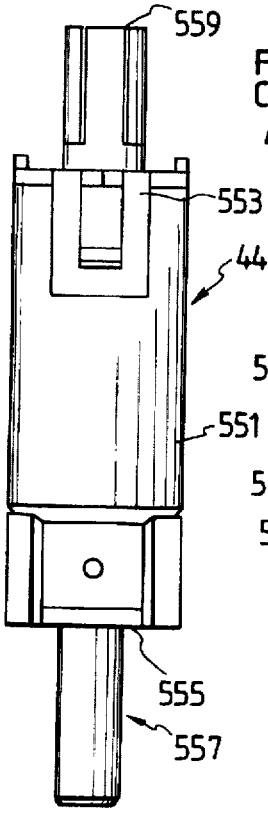
FIGS. 7A to 7C are explanatory views for explaining the construction and operation of a pump used in the preferred embodiment.
Figure 7B:
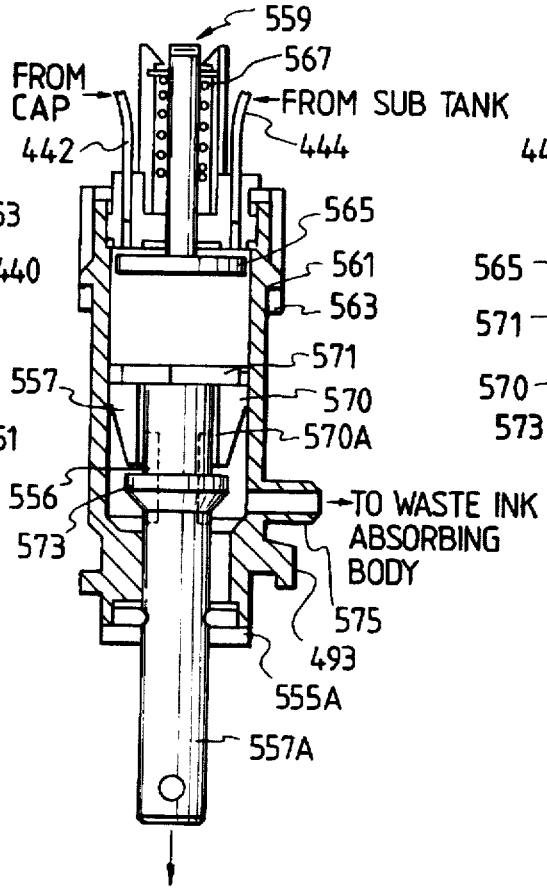
Figure 7C:
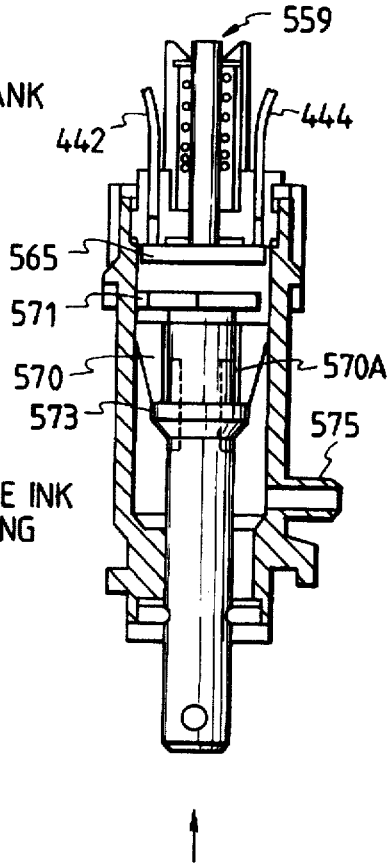

FIGS. 7A to 7C show the construction of the pump 440 in this embodiment. The pump 440 has a cylinder body 551, cylinder heads 553, 555, a piston 557 and a valve unit 559. The valve unit 559 is attached to the cylinder head 553 which has portions 563 snappingly attached to projections 561 formed on the cylinder body 551. In this way, the valve unit 559 and the cylinder head 553 can easily be attached to the cylinder body.

The valve unit 559 has a valve body 565 capable of opening and closing an ink introduction opening from the cap side and the sub-tank side, and a spring 567 for biasing the valve body toward a closed position.

The piston 557 comprises a piston shaft 557A having a flow passage 556 formed thereon, spaced valve body 571 and flange 573 formed on the piston shaft 557A, and a bush 570 freely mounted on the piston shaft 557A between the valve body and the flange and having an ink flow passage 570A therein. Further, the cylinder head 555 has a seal portion 555A and is attached to the cylinder body 551, similar to the cylinder head 553.

With this arrangement, as shown in FIG. 7B, when the piston is displaced downwardly, the valve body 565 is shifted by the negative pressure generated in an upper chamber in opposition to a biasing force of the spring 567 to open the ink introduction opening, thereby absorbing the ink from the caps and the sub-tanks, and at the same time, since the flow passage 570A is closed by the valve body 571, the ink in a lower chamber is discharged via a pipe portion 575 without back flow. Thereafter, as shown in FIG. 7C, when the piston 557 is displaced upwardly, the valve body 571 releases the flow passage 570A, with the result that the ink accumulated in the upper chamber is sent to the lower chamber via the flow passages 570A, 556. Further, in this case, since the ink introduction opening is closed by the valve body 565, the ink does not flow back to the caps and the sub-tanks.

The pump 440 so constructed and so operated is attached to the housing 401 by the holder member as shown in FIG. 3B. Further, in the illustrated embodiment, the pump 440 is associated with each cap and accordingly each recording head, and thus, four pumps are provided in total. In the illustrated embodiment, four recording heads are provided for inks having different colors (yellow, magenta, cyan, black).

Figure 8:
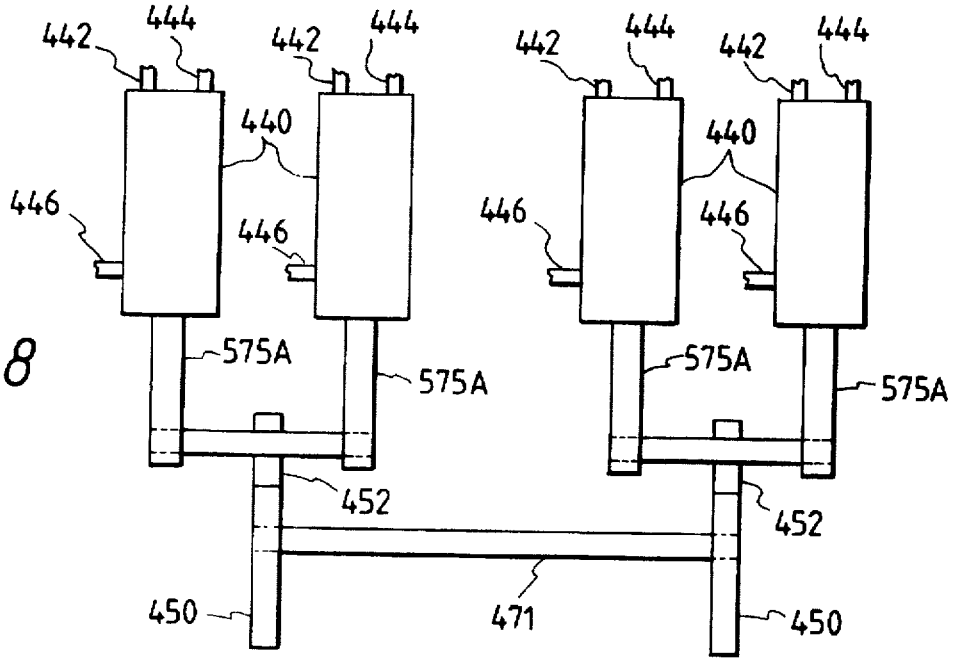
FIG. 8 is a schematic view showing an example of a pump drive system.

FIG. 8 shows a drive apparatus for the four pumps in this embodiment. As shown, in this embodiment the pumps are divided into two pairs, and the paired pumps are driven by cams 450 secured to a shaft 471 and levers 452. In the illustrated embodiment, the phase of the cam associated with one pair is the same as the phase of the cam associated with the other pair, and accordingly, the four pumps 440 are driven with the same phase.

Figure 9:
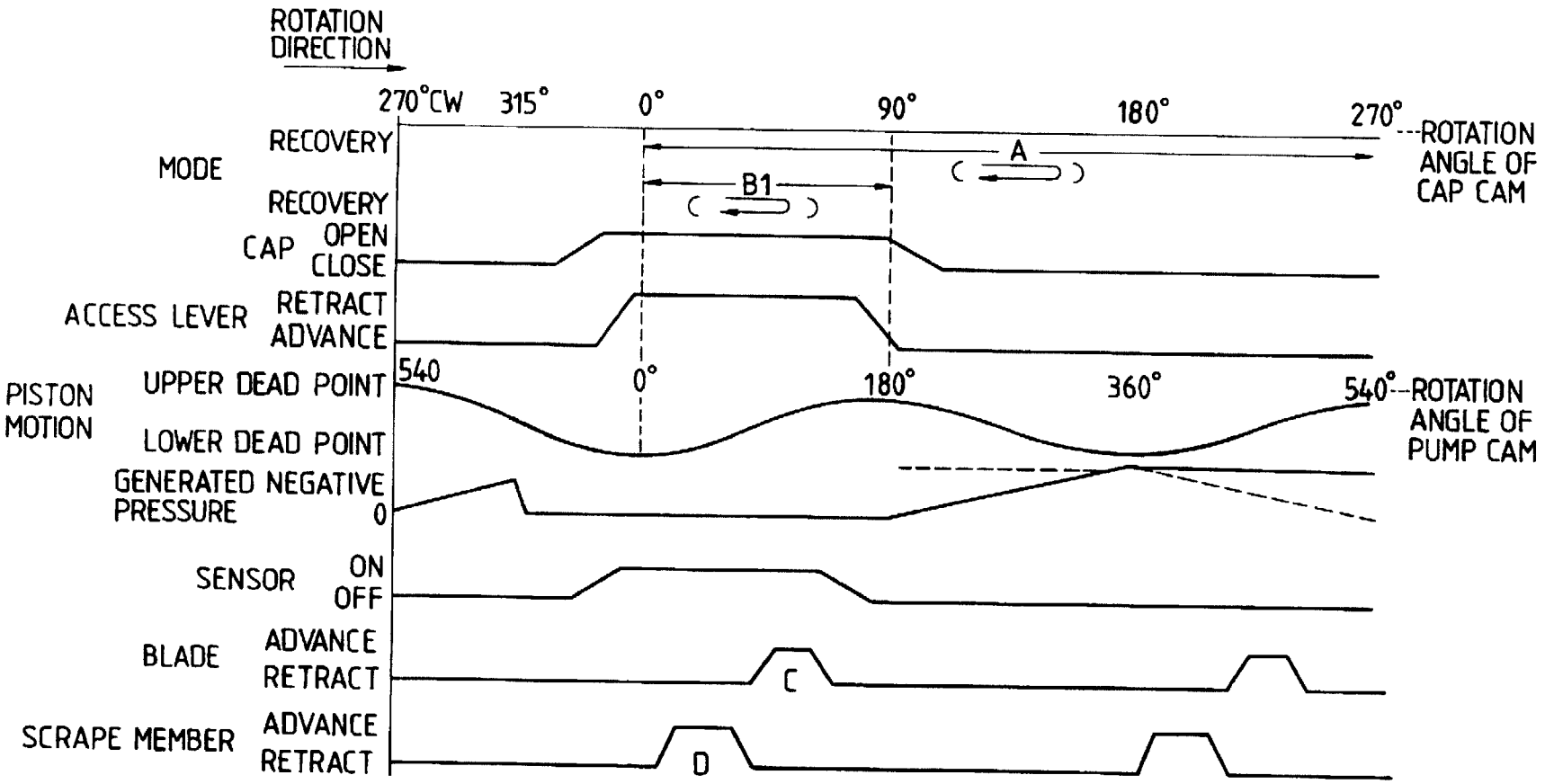
FIG. 9 is a timing chart for explaining the timing of operations of various parts of the recovery unit according to the preferred embodiment.

The operation timing of the cams and the parts driven these cams in the recovery unit is determined, for example, as shown in FIG. 9. Incidentally, in FIG. 9, a "sensor" is a sensing element for detecting the opening/closing condition of the caps.

A head refreshing mode for correcting the ink discharge to the normal one after the recording head have been unused for a long time will be explained with reference to FIGS. 9 and 12. Incidentally, in this embodiment, an example of a mode effected in a condition that the caps are separated from the discharge opening forming surfaces (i.e., the caps themselves are communicated with the atmosphere) will be described.

First of all, a head heat keeping temperature of the recording head which has been unused for a long time is changed from 35° C. to 65° C. (preferably more than 60° C., and more preferably less than 70° C.) in order to enhance the recovery effect. FIG. 12 is a flow corresponding to the timing chart of FIG. 9 and is used for supplementary explanation.

When the head temperature reaches 65° C., the various cams of the recovery unit are rotated by one resolution within a range A (FIG. 9). As a result, the piston is driven while the caps are sealingly contacted with the discharge opening forming surfaces of the recording heads to absorb the ink. Then, the caps are separated from the discharge opening forming surfaces. Thereafter, the piston is further driven to absorb the ink from the interior of the caps. In this way, it is possible to remove any bubbles (in the heads) generated by abruptly increasing the recording heads to 65° C. In this case, the proper positional relation between the heads for different colors and the caps is maintained by reciprocally shifting the access lever with respect to the carriage.

Then, the carriage is retracted from the home position where the recovery unit is situated toward the recording area, and then the cams are stopped at a position C and the blade is advanced toward the carriage. In this condition, by shifting the carriage toward the home position again, the ink droplets and dirt adhered to the discharge opening forming surfaces are removed by the blade.

Then, the drive frequency is reduced to 3 KHz which is a half of a value applied in the normal recording operation while reciprocally rotating the cams within a range B1, and the heater is activated for the pulse time 4 μs which is longer than the pulse time 3 μs applied in the normal recording operation by 1 μs, thereby discharging the ink toward the opposed caps. Incidentally, in the above-mentioned ink discharge process, by rotating the cam by one revolution within a range B1, the absorb pump (suction pump) is driven by one stroke in the condition that the caps are separated from the discharge opening forming surfaces, thereby performing the idle absorb in accordance with the ink discharge. While the absorb pump is being driven by one stroke by rotating the cam by one revolution within the range B1, the ink discharge of 10000 pulses per each discharge opening from the recording head is effected. This discharge amount of ink is an amount which can be absorbed by the action of the pump before the ink discharged toward the cap overflows from the cap. When the ink discharge of 250000 pulses per each discharge opening is effected, i.e., when the pump is driven by 25 strokes (reciprocated by 25 times), the discharge in the flashing mode is finished. Also in this case, the access lever repeats the advancing and retracting movements with respect to the carriage, thereby maintaining the head ink discharge and the position of the caps properly to prevent the ink from being discharged out of the caps.

Then, after the carriage is retracted again from the home position where the recovery unit exists toward the recording area, the blade is advanced to a position C and is fixed there and then the carriage is shifted toward the home position, thereby cleaning the discharge opening forming surfaces. Thereafter, the blade is retarded, and the cams are fixed at a position D. The scrape member is advanced toward the carriage. Then, the carriage is reciprocated on the scrape member to further clean the discharge opening forming surfaces of the heads. Thus, all processes of the flashing mode are completed. In this way, since the ink discharged in the caps is absorbed in the condition that the caps are separated from the recording heads, the negative pressure generated by the pump does not advertently affected on the recording heads, thereby performing the discharge recovery including the refleshment of the heater due to the heat generated by the heater.

According to the illustrated embodiment, since the caps are separated from the discharge opening forming surfaces by the predetermined distance, the discharge opening forming surfaces by the predetermined distance, the discharge opening forming surfaces are not covered by the ink due to the rebound of the ink in the caps, thus preventing the poor discharge.

Further, even if the ink mist is adhered to the discharge opening forming surfaces, since the latter is cleaned after the ink discharge, the wetted condition of the discharge opening forming surfaces is eliminated, thus avoiding any problem regarding the ink discharge. Further, since the ink is discharged always toward the caps and the ink is absorbed from the caps in accordance with the amount of the discharged ink, the discharge recovery can be effectively performed without using the recording medium which has been utilized to absorb the discharged ink.

Next, another example of the head flashing mode according to the present invention, will be explained. Since the main construction of the recording apparatus, the construction and operation of the recovery unit are the same as those in the aforementioned embodiment, the explanation thereof will be omitted.

Figure 10:
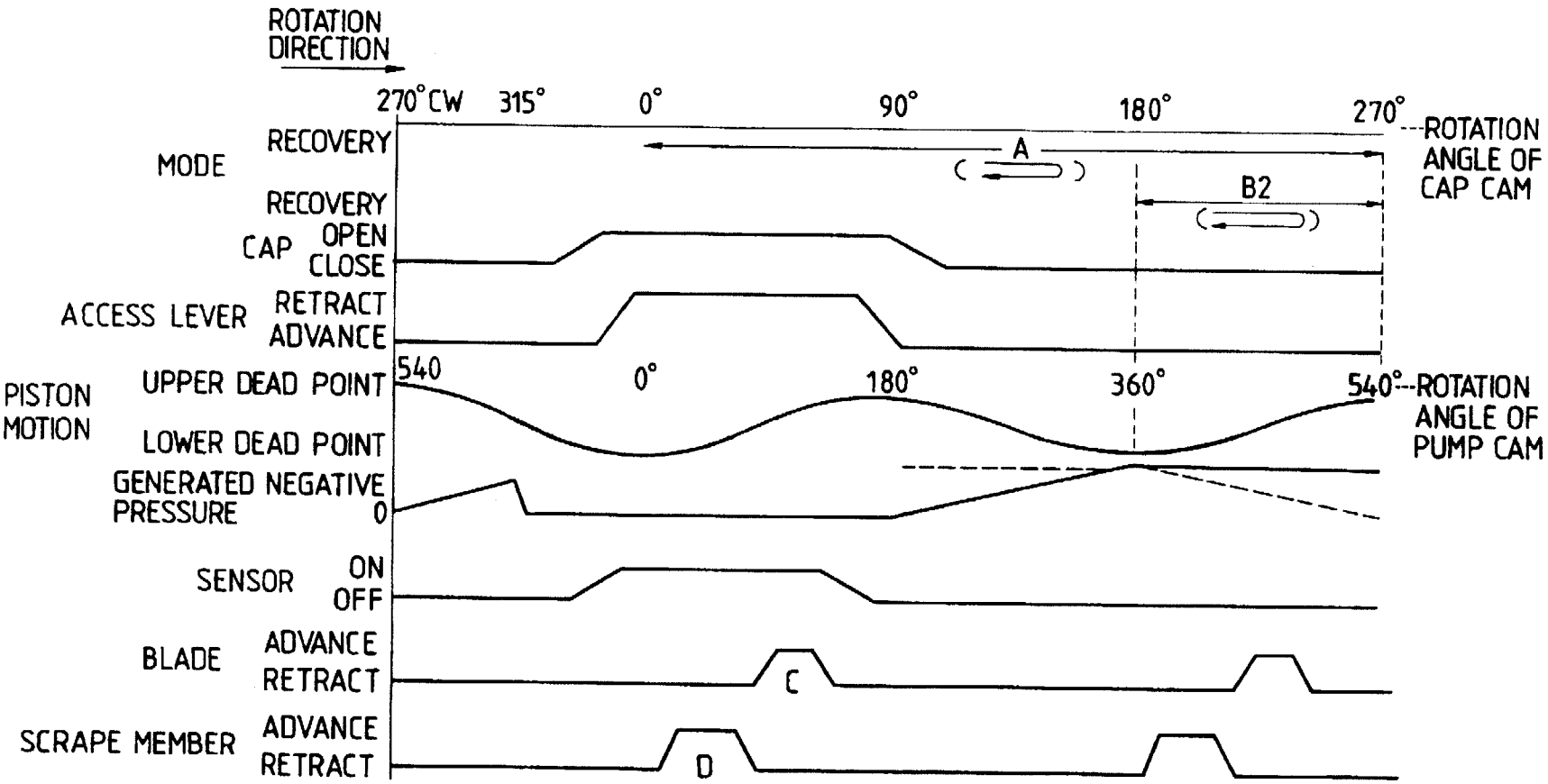
FIG. 10 is a timing chart for explaining the timing of operations of various parts of the recovery unit according to another embodiment.

FIG. 10 shows the operation timing of various parts of the recovery unit in this embodiment. The flashing mode will be explained with reference to the operation timing chart of FIG. 10. Incidentally, this embodiment relates to an example of the mode effected in a condition that the vent hole opening/closing valve regarding the cap portion is opened (to communicate the interior of the cap portion with the atmosphere). In carrying out this mode, when the ink discharge condition and the suction force of the absorb pump are set so that a small amount (which can be absorbed by the absorbing body) of the discharged ink remains in the caps, it is possible to prevent the ink from overflowing from the caps, thus avoiding the contamination of the head surfaces with the ink. The embodiment of FIG. 9 is more preferable than that of FIG. 10 since the rebound amount of ink is less.

First of all, a head heat keeping temperature of the recording head which has been unused for a long time is changed from 35° C. to 65° C. in order to enhance the recovery effect. When the head temperature reaches 65° C., the various cams of the recovery unit are rotated by one revolution within a range A (FIG. 10). As a result, the piston is driven while the caps are sealingly contacted with the discharge opening forming surfaces of the recording heads to absorb the ink. Then, the caps are separated from the discharge opening forming surfaces. Thereafter, the piston is further driven to effect the idle absorb of the ink in the caps. In this way, it is possible to remove any bubbles (in the heads) generated by abruptly increasing the temperature of the recording heads. In this case, the proper positional relation between the heads for different colors and the caps is maintained by reciprocally shifting the access lever with respect to the carriage.

Then, the carriage is retracted from the home position where the recovery unit is situated toward the recording area, and then the cams are stopped at a position C and the blade is advanced toward the carriage. In this condition, by shifting the carriage toward the home position again, the ink droplets adhered to the discharge opening forming surfaces are removed by the blade.

Then, the drive frequency is reduced to 3 KHz which is a half of a value applied in the normal recording operation while reciprocally rotating the cams within a range B2, and the ink is discharged toward the opposed caps in a condition that the pulse time is longer than the pulse time 3 μs applied in the normal recording operation by 1 μs. When the cams are reciprocated by one time within the range B2, the absorb pumps are shifted by one stroke while closing the caps (sealingly contacting the caps with the discharge opening forming surfaces), thereby absorbing the ink from the discharge openings. Incidentally, in this case, the vent hole opening/closing valve regarding the caps is in an open position so that the interior of the caps is communicated with the atmosphere. Only when the pump cam is shifted from an upper dead point (540° position) to a lower dead point (360° position) and the absorb operation is being effected, the discharge of 5000 pulses per each discharge opening is effected. This discharge amount of ink is an amount that the ink does not overflow from the closed caps. When the ink discharge of 250000 pulses per each discharge opening is effected, i.e., when the pump is driven by 50 strokes (reciprocated by 50 times), the discharge in the recovery mode is finished. this case, the access lever is inserted into the carriage, thus maintaining the proper position of the caps.

Then, after the carriage is retracted again from the home position where the recovery unit exists, the blade is fixed at a position C. After the discharge opening forming surfaces are cleaned while shifting the carriage toward the home position, the cams are fixed at a position D, and the scrape member is advanced toward the carriage. Then, the carriage is reciprocated on the scrape member to further clean the discharge opening forming surfaces. In this way, the discharge recovery operation is completed.

As mentioned above, since the flashing mode is effected in the condition that the caps communicated with the atmosphere are abutted against the heads, the negative pressure generated by the pumps does not advertently affect on the recording heads, thereby effectively performing the discharge recovery including the refleshment of the heater due to the heat generated by the heater. Further, also in this embodiment, since the ink is absorbed from the caps in accordance with the amount of the discharged ink, the discharge recovery can be effectively performed without using the recording medium which has been utilized to absorb the discharged ink.

Incidentally, in the illustrated embodiment, when the ink discharge and the ink absorb in the caps are performed, by performing the ink discharge and the ink absorb in the caps in a condition that the caps are not communicated with the atmosphere but are sealingly closed, the ink in the discharge openings is forcibly pulled to create the positive ink flows, thereby changing the positions (on the surfaces of the heat generating elements) where the bubbles are generated and the bubbles disappear, with the result that it is possible to effectively activate the whole surfaces of the heat generating elements. Further, in the above-mentioned embodiment, while an example that the recording heads have been unused for a long time was explained, this embodiment may be applied to activate the discharge openings which have not been used for a long time because the ink is continuously discharged from the other discharge openings.

By the way, in the above-mentioned embodiments, the discharge condition or requirement of the refreshing recovery operation for activating the heater is that an amount of the electrical energy is increased by increasing the drive voltage or by lengthening the width of the drive pulse with respect to the ink discharge condition for the recording operation.

Now, the amount of the electrical energy to be applied will be discussed. In this discussion, a value K which is a ratio between the bubble generation start voltage (minimum discharge voltage) Vo and the drive voltage V is introduced. That is, K=V/Vo.

The relation between the drive pulse width and the value K will be as follows:

$$T=K^2\times To.$$

Where, To is the pulse width at the start of the bubble generation, T is the drive pulse width, and K is the value K.

In this embodiment, the drive voltage is fixed in consideration of the property of the recording head, and the preferable drive condition is sought by varying the number of drive pulses.

The Table 1 (shown below) show the effect of the discharge recovery when the number of drive pulses is varied in connection with the value K. That is to say, the recovery condition is checked by selecting the value K to 1.15, 1.20, 1.25, 1.30 while fixing the drive voltage for the recording head to 28V and by setting the number of pulses for the recovery to $1\times10^5$, $2\times10^5$, $3\times10^5 4\times10^5$, $5\times10^5$. Incidentally the frequency for driving the head is selected to 3.0 KHz, the head heat keeping temperature is selected to 65° C., and the discharge pulse width Top in the recording operation is selected to 3.0 μs.

Further, as to the evaluation, after the recovery operation, the case where the print condition is recovered noticeably is shown by a symbol ○, the case where the print condition is recovered more or less is shown by a symbol Δ, the case the recovery condition is bad is shown by a symbol X. Incidentally, in the discharge recovery treatment, the greater the head heat keeping temperature the smaller the energy amount to be applied, and thus, the recovery can be performed effectively by smaller amount of the discharge ink (smaller number of pulses).

As apparent from the result shown in the Table 1, when the value K is greater than 1.25 and the number of recovery discharge pulses is greater than $2\times10^5$ the heater can be effectively activated, thus permitting the recovery treatment having the good discharge condition. In this way, the Table 1 indicates the fact that the number of the recovery discharge pulses can be reduced by increasing the value K, and therefore, the value K providing the sufficient recovery can be set if the number of pulses is in the order of $10^4$. In this embodiment, since the frequency is set to 3 KHz, the allowance value can be greater. If the frequency is set to 6 KHz, the number of the recovery discharge pulses can be reduced by increasing the value K. However, in this embodiment, since the value K is increased by lengthening the drive pulse width, it has a certain limitation. Thus, the value K is preferably more than 1.25 and less than 1.30.

TABLE 1

(Recovery effect when the pulse width is increased)

| Value | Discharge Pulse Number: Number of Recovery Discharge Pulses | | | | | |
|---|---|---|---|---|---|---|
| K | $1\times10^5$ | $2\times10^5$ | $3\times10^5$ | $4\times10^5$ | $5\times10^5$ | Remarks |
| 1.15 | X | X | X | X | X | Normal Discharge Condition (Voltage 28V Fixed) |
| 1.20 | X | X | X | X | X | (Voltage 28V Fixed) |
| 1.25 | X | Δ | ○ | ○ | ○ | (Voltage 28V Fixed) |
| 1.30 | Δ | ○ | ○ | ○ | ○ | (Voltage 28V Fixed) |

Other remarks: Head Drive Frequency 3.0 KHz
Head Heat Keeping Temperature 65° C.
Normal Discharge Pulse Width Top = 3.0 μs Evaluation ○: Print Quality Recovered
Δ: Print Quality Recovered More or Less
X: Print Quality Not Recovered (Bad)

Figure 11:
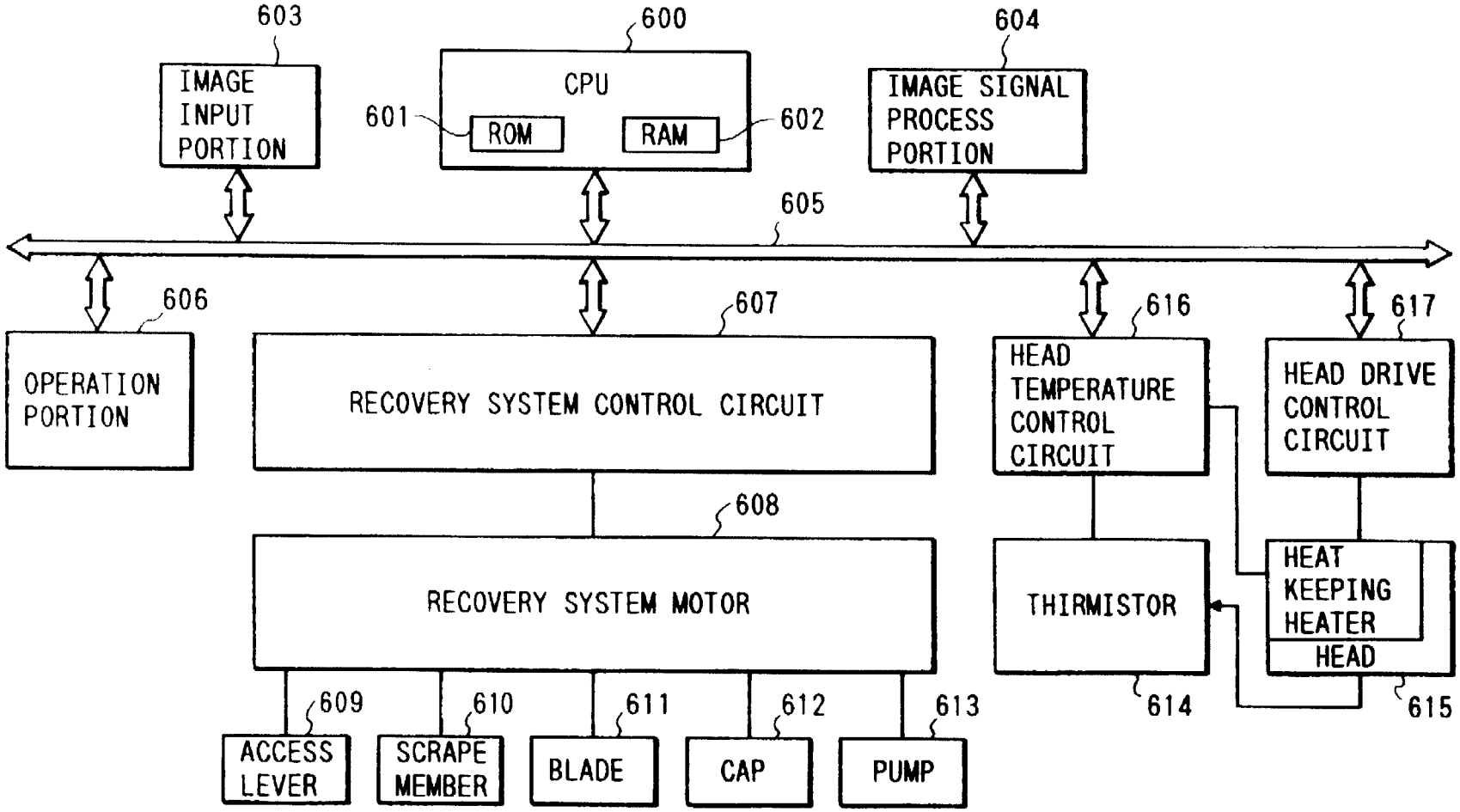
FIG. 11 is a block diagram of a recording apparatus according to the present invention.

FIG. 11 is a block diagram for the ink jet recording apparatus according to the present invention. In FIG. 11, the apparatus comprises an image input portion 603, an image signal process portion 604 corresponding to the image input portion, a soft system process means such as a central control portion or CPU 600, an operation portion 606, a recovery system control circuit 607, an ink jet head temperature control circuit 616, and a hard system process means such as a head drive control circuit, which are all accessible to a main path line 605.

The CPU 600 normally includes a ROM 601 and a random access memory (RAM) 602, and serves to provide the proper recording condition in response to the input information and to drive the recording heads 615 for the recording operation. Further, the program for carrying out the above-mentioned recovery timing chart was previously stored in the RAM 602, and provides the recovery condition such as the preliminary discharge condition to the recovery system control circuit 607, the recording heads and a heat keeping heater as needed (for example, in response to the start command for the positive recovery mode from the operation portion 606). A recovery system motor 608 serves to drive the above-mentioned access lever 609 as the mechanical means for engaging and positioning the recording heads and the spaced caps, the scrape member (made of urethane sponge or the like) 610, the cleaning blade 611 and the absorb pump 613. The head drive control circuit 617 carries out the drive condition for the ink discharging electro-thermal conversion bodies of the thermal heads and normally causes the recording heads to carry out the preliminary discharge, the recording ink discharge, and the recovery preliminary discharge under the high level drive condition such as the flashing mode according to the present invention.

On the other hand, in the thermal head, the heat keeping heater is provided on a substrate on which the ink discharging electro-thermal conversion elements are arranged and serves to heat and adjust the temperature of the ink in the head to the desired set temperature. The heat keeping heater may be of external heating type or may be arranged to heat the ink in a common liquid chamber communicated with a multiple of 64 or 128 discharge openings, rather than being provided on the substrate. Further, a thermistor 614 is also provided on the substrate and serves to measure substantially the temperature of the ink in the head. Similarly, the thermistor may be arranged externally or may be arranged in the proximity of the recording head, rather than being provided on the substrate.

In the apparatus shown in FIG. 11, as the normal recovery mode, the absorb recovery from the recording thermal heads while the caps are sealingly contacted with the heads, the normal preliminary discharge (by the number of pulses less than the order of $10^3$) or the normal blade cleaning is effected. Further, the apparatus shown in FIG. 11 can also carry out the flow chart of FIG. 12 as the positive recovery mode. Normally, the head temperature control circuit 616 adjusts the temperature of the head to 35° C., and limiter-controls the temperature on the basis of the abnormal temperature increase limitation of 70° C. As mentioned above, in the positive recovery mode, since temperature adjust setting temperature is limited to 65° C., by changing the abnormal temperature increase limitation to 80° C., it is possible to perform the temperature adjust of 65° C.

Figures 12, 12A:
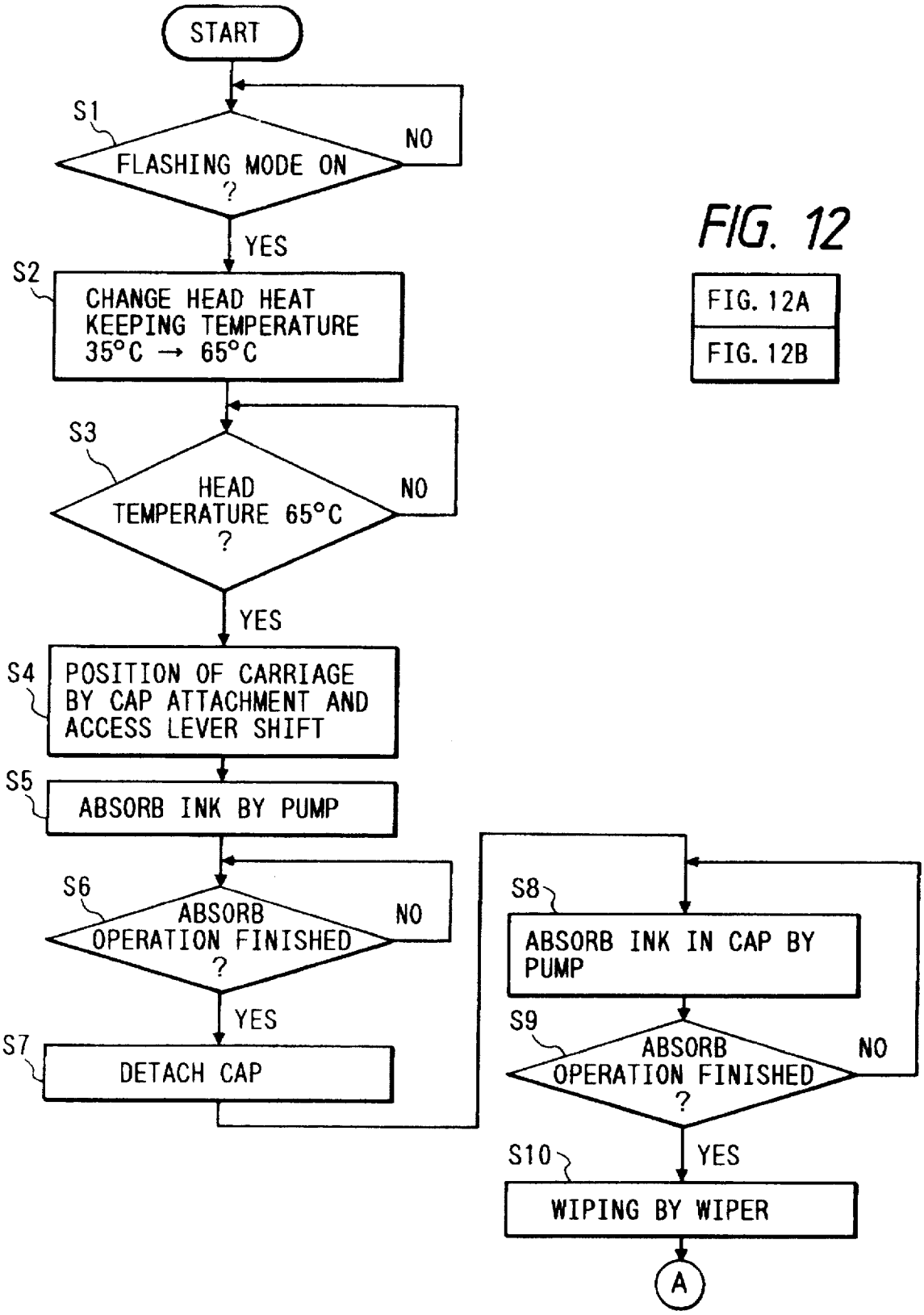
FIG. 12 which comprises
FIGS 12A and 12B is a flow chart regarding a recording apparatus and method according to the present invention.
Figure 12B:
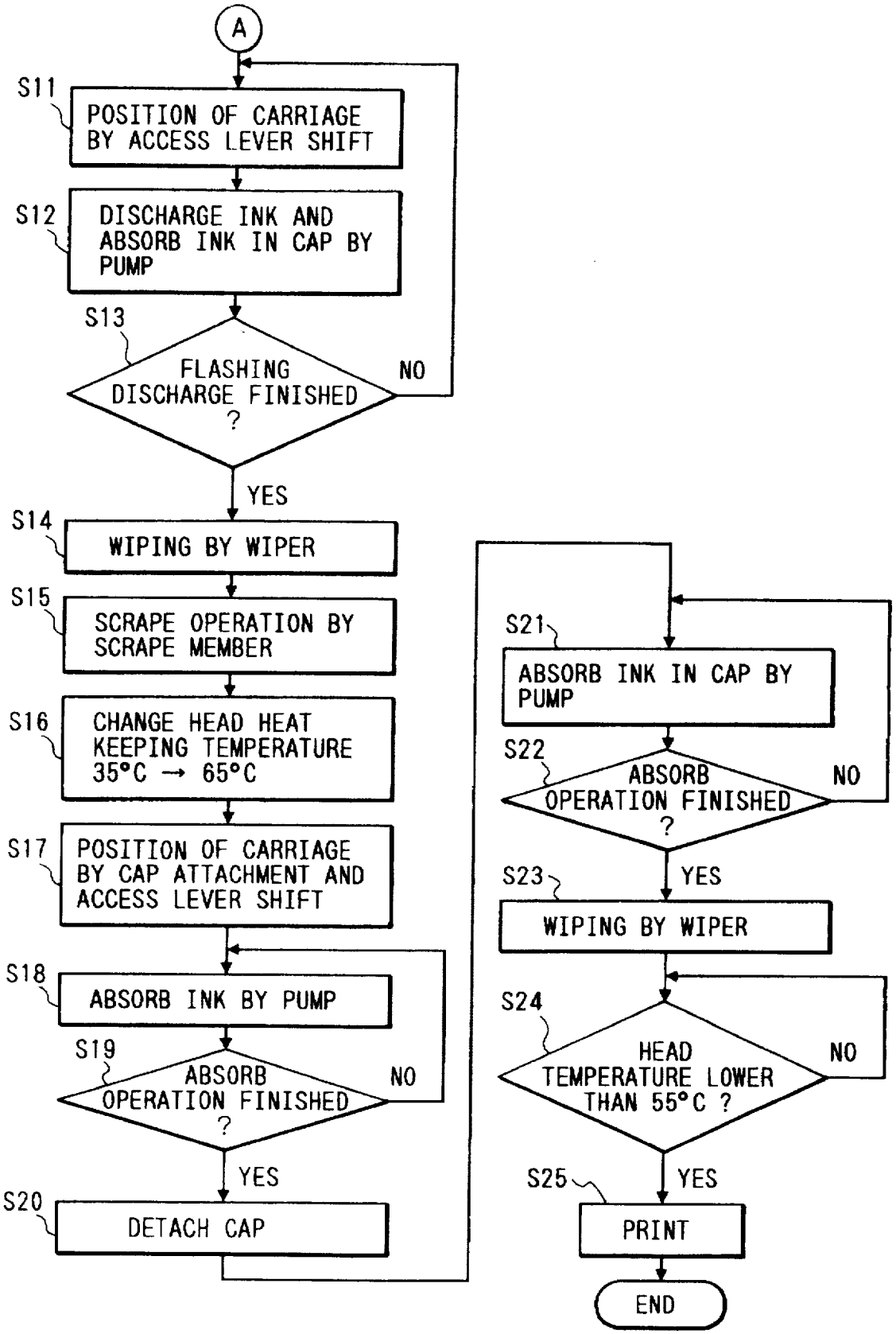

In FIG. 12, the processes from a step S1 to a step S10 are effected as the pre-process steps in carrying out the flashing mode, and a step S11 corresponds to the positioning operation by the mechanical engagement in the present invention. Now, the best mode will be described.

When the flashing mode is selected, the judgement in the step S1 becomes "Yes", thereby changing the head heat keeping temperature from the normal 35° C. to 65° C. by heating the heads by the heat keeping heater up to the set temperature (step S3). When the temperature adjust of 65° C. is reached, since the air dissolved in the ink sometimes remains as minute bubbles in the heads due to the high temperature adjustment, the recovery under the normal absorb recovery condition is effected at steps S4 to S6 to remove the bubbles. In this case, the positioning by the access lever is not required, but in the illustrated embodiment, the high accuracy positioning at the flashing mode is used. When the absorb is finished, the caps are detached or separated from the recording heads (step S7), and then the ink in the caps is absorbed by the normal idle absorb mode (steps S8, S9). This is done to remove the ink from the caps and to initialize to a condition capable of holding the large amount of ink generated by the flashing preliminary discharge in the caps more surely. Thereafter, in a step S10, the discharge opening forming surfaces of the recording heads are further cleaned by the wiper blade to previously remove the cause of the adhesion of the ink droplets.

Incidentally, while the above-mentioned temperature adjust of 65° C. was effected independently, attaching more importance to the prevention of the vaporization of the dissolved bubbles,at the same time the change to the temperature adjust of 65° C. is effected, the ink in the heads may be heated while maintaining the ink in the proper condition by effecting the aforementioned absorb recovery process at the same time that the change to the temperature adjust of 65° C. is effected.

Next, in a step S11, the position of the caps separated from the recording heads re-acertained or finely adjusted. This step is particularly effective to a recording apparatus of carriage shifting type or a recording apparatus wherein the drive of the recovery means is changed in response to the shifting movement of the carriage. In any case, in the step S11, the correct positional relation between the recording heads and the caps separated therefrom is maintained only by engaging the access lever by the carriage substantially without shifting the caps in the front and rear direction.

Thereafter, in a step S12, the preliminary discharge regarding the recording heads is effected with the energy higher than that in the normal preliminary discharge (in this embodiment, the energy is increased by lengthening the width of the supply pulses), and at the same time the idle absorb process is carried out regarding the interior of the caps. In this way, the deposit on the heat surfaces (acting on the ink) of the electro-thermal conversion elements is removed, with the result that the thermal energy can be effectively utilized to form the bubbles due to the film boiling for the recording operation, thus achieving the recovery of the interior of the heads. At the same time, there is no ink adhered on the discharge opening forming surfaces of the recording heads, which cannot be removed therefrom.

Then, in a step S14, the discharge opening forming surfaces are cleaned by the wiper blade to remove the water droplets generated by the high temperature adjust and adhered to the heads. In this embodiment, while the wiping operation in the step S14 was effected after the flashing discharge operation, more preferably, the wiping operation may be performed each time the number of the flashing discharges reaches $1\times10^4$. This is done to prevent the fact that the water droplets adhered to the heads adsorb the floating dirt and the like. In a preferred example of the illustrated embodiment, when the total number of the flashing pulses is $2.5\times10^5$, the wiping operation is effected (by interrupting the preliminary discharge and the idle absorb) each time $5\times10^4$ pulses are emitted, and after the positioning in the step S11 is effected the preliminary discharge and the idle absorb are re-started.

The scrape operation by the scrape member in a step S15 is effected as needed, and in the illustrated embodiment, this scrape operation is performed because this embodiment utilizes a plurality of color recording heads. This operation is done to properly recover the function of water repelling surfaces normally formed on the discharge opening forming surfaces. When the substantial flashing process is finished, the recording heads must be returned to the recordable condition immediately. Thus, in the illustrated embodiment, as a matter of course, first of all, the head heat keeping is returned to the normal temperature of 35° C. (step S16).

Further, since the ink in the recording heads is heated, in steps S17 to S22, the heated ink is discharged and the temperature of ink is gradually and surely decreased. More particularly, the caps are sealingly attached to the recording heads (step S17), the absorb recovery is effected (step S18), the caps are detached from the heads (step S20), and the idle absorb is effected (step S21). In this way, the ink in the caps is further reduced and new ink is introduced in the heads, thus decreasing the head heat keeping temperature. The wiping operation in a step S23 is effected to remove the ink adhered to the discharge opening forming surfaces when the caps are abutted against the latter.

Thereafter, when the head temperature is decreased below 55° C. (step S24), the recordable condition is displayed in a step S25. In this way, all of the processes of the flashing mode are completed.

As mentioned above, while in the illustrated embodiment the preferred conditions were all effected, it should be understood that the claimed inventions can achieve the effective advantages, respectively.

Incidentally, according to the present invention, an excellent effect can be obtained in a recording head and a recording apparatus of a type having a thermal energy generating means (for example, electro-thermal conversion element or laser beam) for generating thermal energy as energy utilized to discharge ink and wherein the condition of ink is changed by the thermal energy, among the ink jet recording apparatuses, since the high density recording with the high resolving power can be achieved.

It is preferable to employ the typical structure and the principle of structures disclosed in, for example, U.S. Pat. Nos. 4,723,129 and 4,740,796. This system can be adopted in a so-called "On-Demand" type and "Continuous" type. Particularly, in the system of On-Demand type, an electro-thermal conversion element disposed to align to a sheet or a liquid passage in which liquid (ink) is held is supplied with at least one drive signal which corresponds to information to be recorded and which enables the temperature of the electro-thermal conversion element to be raised higher than a nuclear boiling point, so that thermal energy is generated in the electro-thermal conversion element and film boiling is caused to take place on the surface of the recording head which is heated. As a result, bubbles can be respectively formed in liquid (ink) in response to the drive signals. Due to the enlargement and contraction of the bubble, liquid (ink) is discharged through the discharge opening, so that at least one droplet is formed. In a case where the aforesaid drive signal is made to be a pulse signal, a further satisfactory effect can be obtained in that the bubble can immediately and properly be enlarged/contracted and liquid (ink) can be discharged while exhibiting excellent responsibility. It is preferable to employ a drive signal of the pulse signal type disclosed in U.S. Pat. Nos. 4,463,359 and 4,345,262.

Furthermore, in a case where conditions for determining the temperature rise ratio on the aforesaid heated surface disclosed in U.S. Pat. No. 4,313,124 are adopted, a further excellent recording operation can be performed.

In addition to the structure (a linear liquid passage or a perpendicular liquid passage) of the recording head formed by combining the discharge ports, the liquid passage and the electro-thermal conversion members disclosed in the aforesaid specifications, a structure disclosed in U.S. Pat. Nos. 4,558,333 and 4,459,600 in which the heated portion is disposed in a bent portion is included in the scope of the present invention. Furthermore, the present invention can effectively be embodied in a structure in which a common slit is made to be the discharge portion of a plurality of electro-thermal conversion members and which is disclosed in the Japanese Patent Laid-Open No. 59-123670 and a structure in which an opening for absorbing thermal pressure wave is formed to align to the discharge opening and which is disclosed in the Japanese Patent Laid-Open No. 59-138461.

The present invention is also effectively applicable to a full line type recording head having a length which corresponds to the width of the maximum recording medium which can be recorded by the recording apparatus. Such a recording head may be a structure capable of realizing the aforesaid length and formed by combining a plurality of recording heads or a structure formed by a integrally formed recording head.

In addition, among the aforesaid serial types, the present invention can also be adapted to a structure having a recording head fixed to the body of the apparatus, or an interchangeable chip type recording head which can be electrically connected to the body of the apparatus or to which ink can be supplied from the body of the apparatus when it is mounted on the body of the apparatus, or a cartridge type recording head integrally formed with the recording head.

Furthermore, regarding the kind and number of recording heads to be mounted, for example, a single head corresponding to a single color ink or a plurality of heads corresponding to plural inks each having different color or density may be mounted on the carriage. More particularly, for example, the recording mode of the recording apparatus may be a recording mode for recording only main color such as black and a structure may be that formed by integrally forming recording heads or formed by combining a plurality of recording heads. The present invention can significantly effectively be adapted to an apparatus having a recording head of a plurality of colors or at least one full color head arranged to mix colors.

Further, although the above-mentioned embodiment of the present invention use liquid ink, ink which solid at room temperature or ink which is softened at room temperature can be used. In the aforementioned ink jet apparatus, the temperature of ink is usually controlled in a range from 30° C. to 70° C. to make the viscosity of ink to be in a stable discharge range and thereby ink which is liquefied in response to a record signal supplied may be used. Furthermore, ink the temperature raise of which is prevented by positively using the temperature rise due to the thermal energy as energy of state change from the solid state to the liquid state of ink or ink which is solidified when it is allowed to stand in order to prevent the evaporation of ink may be used. That is, ink which is liquefied by thermal energy such as ink liquefied by thermal energy supplied in response to the record signal and discharged as ink droplet or ink which is solidified when it reaches the recording medium can be employed in the present invention. In the present invention, it is most preferable that ink be discharged by the aforementioned film boiling method.

In addition, the ink jet recording apparatus according to the present invention can be used as an image output terminal device of an information processing equipment such as a computer, as a copying machine combined with a reader, or as a facsimile having communication function.

As mentioned above, according to the present invention, since the ink discharged toward the cap member is absorbed by the negative pressure generated in the cap member which is communicated with the atmosphere, it is possible to effectively remove the ink discharged into the cap member, and further, since the cap member is communicated with the atmosphere with respect to the recording means, the negative pressure generated in the cap member is used only for the removal of ink and does not advertently affect on the recording means. As a result, the heater of the recording means can be operated extremely effectively by the ink discharge for the discharge recovery including the activation of the heater, thereby providing an ink jet recording head capable of improving the recovery effect.

Further, since the recovery by the ink discharge can be effected without using any recording medium, the recording medium is not used in vain. In addition, since the ink discharge and the ink absorb are effected substantially in synchronous with each other, it is possible to reduce the time required for the recovery treatment, thereby providing an ink jet recording apparatus capable of effecting the recovery operation including the activation (refreshment) of the heater of the recording means for a short time.

What is claimed is:

1. An ink jet recording apparatus which uses a recording head for discharging ink from a discharge opening by forming a bubble generated by applying thermal energy to a heat acting portion of said recording head, said apparatus comprising:

a capping member for capping the discharge opening;

control means for controlling a temperature of said recording head to become higher than a temperature at a normal ink discharge;

suction means for sucking ink from the discharge opening and from said capping member through said capping member, after temperature control by said control means; and recovery means for effecting $10^4$ or more times of preliminary discharges of ink from said recording head toward said capping member when said capping member is detached from said recording head after the ink suction from the discharge opening by said suction means, by supplying energy greater than energy at a recording condition by predetermined multiples of a minimum energy $E_o$ required for generating the bubble, said recovery means including means for concurrently causing said suction means to suck the ink in said capping member that is open to atmosphere.

2. An ink jet recording apparatus according to claim 1, wherein said recovery means includes a mechanical positioning mechanism for positioning said capping member detached from the recording head in a spaced and confronting relation to each other by mechanically engaging said capping member by the recording head, and wherein an ink receiving portion of said capping member is confronted to the discharge opening by said mechanism before the recovery is effected.

3. An ink jet recording apparatus according to claim 2, wherein said mechanical positioning mechanism is a lever extendable from said capping member to the recording head, and wherein said ink receiving portion of said capping member is provided with an ink absorber.

4. An ink jet recording apparatus according to claim 2, wherein said ink receiving portion of said capping member comprises an absorbing means for absorbing the ink, and said mechanical positioning mechanism causes the engagement between said capping member and the recording head each time an absorbing operation of said absorbing means is effected.

5. A method for recovering a thermal ink head for discharging ink from a discharge opening by forming a bubble generated by applying thermal energy to a heat acting portion of the thermal ink head, said method comprising the steps of:

controlling a temperature of said thermal ink head to become higher than a temperature at a normal ink discharge;

sucking the ink from said discharge opening after said controlling step; and recovering the thermal ink head by effecting $2\times10^5$ or more times of preliminary discharges of ink from the thermal ink head toward a capping member for capping the thermal ink head when said capping member is detached from the thermal ink head after said sucking step, by supplying a drive pulse width greater by 1.25 times or more than a minimum drive pulse width required for generating the bubble, and concurrently causing suction means to suck the ink in the capping member that is open to atmosphere.

6. A recovering method according to claim 5, wherein said recovering step includes a step of positioning the capping member detached from the thermal ink head in a spaced and confronting relation to each other by mechanically engaging the capping member by the thermal ink head, and wherein an ink receiving portion of the capping member is confronted to the discharge opening before said recovering step is effected.

7. A recovering method according to claim 6, wherein said positioning step causes an engagement between the capping member and the thermal ink head each time a sucking operation of the suction means is effected.

8. An ink jet recording apparatus which uses a recording head for discharging ink from a discharge opening by forming a bubble generated by applying thermal energy to a heat acting portion of said recording head, said apparatus comprising:

a capping member for capping the discharge opening;

control means for controlling a temperature of said recording head to become higher than a temperature at a normal ink discharge;

suction means for sucking ink from the discharge opening and from said capping member through said capping member, after temperature control by said control means;

mechanical positioning means for positioning said recording head and said capping member detached from said recording head in a spaced and confronting relation to each other by mechanically engaging said capping member by said recording head; and recovery means for effecting preliminary discharges of ink from said recording head toward said capping member detached from said recording head after the ink suction from the discharge opening by said suction means, by supplying energy greater than a minimum energy $E_o$ required for generating the bubble, said recovery means including means for concurrently causing said suction means to suck the ink in said capping member means that is open to atmosphere.

9. A method for recovering a recording head for discharging ink from a discharge opening by forming a bubble generated by applying thermal energy to a heat acting portion of the recording head, said method comprising the steps of:

capping the discharge opening;

controlling a temperature of said heat acting portion to become higher than a temperature at a normal ink discharge;

sucking ink from said discharge opening after said controlling step; and recovering the recording head by effecting $10^4$ or more times of preliminary discharges of ink from the recording head toward a capping member for capping the recording head when the capping member is detached from the recording head after said sucking step, by supplying energy greater than energy at a recording condition by predetermined multiples of a minimum energy $E_o$ required for generating the bubble, and concurrently causing suction means to suck the ink in the capping member that is open to atmosphere.

10. A method according to claim 9, further comprising a step of confronting an ink receiving portion of said capping member to the discharge opening before said recovering step, and wherein said recovering step further comprises positioning said capping member detached from the recording head in a spaced and confronting relation to each other by mechanically engaging said capping member by the recording head.

11. A method according to claim 10, wherein said positioning is performed by a lever extendable from said capping member to the recording head, and wherein said ink receiving portion of said capping means is provided with an ink absorber.

12. A method according to claim 10, wherein said recovering step further comprises absorbing the ink using an absorbing means in said ink receiving portion of said capping member, and wherein said positioning causes engagement between said capping member and the recording head each time said absorbing is performed.

13. A recovery apparatus for a thermal ink head for discharging ink from a discharge opening by forming a bubble generated by applying thermal energy to a heat acting portion of the thermal ink head, said apparatus comprising:

control means for controlling a temperature of said heat acting portion to become higher than a temperature at a normal ink discharge;

suction means for sucking the ink from the discharge opening and from a capping member for capping the thermal ink head through the capping member after temperature control by said control means; and recovery means for effecting $2\times10^5$ or more times of preliminary discharges of ink from the thermal ink head toward the capping member when the capping member is detached from the thermal ink head after the ink suction from the discharge opening by said suction means, by supplying a drive pulse width greater by 1.25 times or more than a minimum drive pulse width required for generating the bubble, and concurrently causing said suction means to suck the ink in the capping member that is open to atmosphere.

14. A recovery apparatus according to claim 13, wherein said recovery means includes a mechanical positioning means for positioning the capping member detached from the thermal ink head in a spaced and confronting relation to each other by mechanically engaging the capping member by the thermal ink head, and wherein an ink receiving portion of the capping member is confronted to the discharge opening before said recovery means effects said preliminary discharges.

15. A recovery apparatus according to claim 14, wherein said mechanical positioning means causes an engagement between the capping member and the thermal ink head each time a sucking operation of the suction means is effected.

16. A method for recovering a recording means for discharging ink from a discharge opening by forming a bubble generated by applying thermal energy to a heat acting portion of the recording means, said method comprising the steps of:

capping the discharge opening by a capping means;

controlling a temperature of said heat acting portion to become higher than a temperature at a normal ink discharge;

sucking ink from said discharge opening after said controlling step;

positioning the recording means and the capping means detached from the recording means in a spaced and confronting relation to each other by mechanically engaging the capping means by the recording means; and recovering the recording means by effecting preliminary discharges of ink from said recording means toward the capping means detached from the recording means by supplying energy greater than a minimum energy $E_o$ required for generating the bubble, and concurrently causing a suction means to suck the ink in the capping means that is open to atmosphere.

* * * * *

UNITED STATES PATENT AND TRADEMARK OFFICE

CERTIFICATE OF CORRECTION

PATENT NO. : 5,701,146

DATED : December 23, 1997

INVENTOR(S) : YUJI AKIYAMA ET AL.

It is certified that error appears in the above-identified patent and that said Letters Patent is hereby corrected as shown below:

COLUMN 3

Line 44, "$10_4$" should read --$10^4$--.

COLUMN 9

Line 41, "driven with" should read -- driven by --.

COLUMN 10

Line 55, "advertently affected on" should read --adversely affect--.
Line 57, "refleshment" should read --refreshment--.

COLUMN 12

Line 25, "on" should be deleted.

COLUMN 13

Line 10, "$3x10^5 4x10^5$," should read --$3x10^5$, $4x10^5$,--.

COLUMN 15

Line 25, "bubbles,at" should read --bubbles, at--.

UNITED STATES PATENT AND TRADEMARK OFFICE

CERTIFICATE OF CORRECTION

PATENT NO. : 5,701,146

DATED : December 23, 1997

INVENTOR(S) : YUJI AKIYAMA ET AL.

It is certified that error appears in the above-identified patent and that said Letters Patent is hereby corrected as shown below:

COLUMN 17

Line 47, "significantly" should read --significantly and--.
Line 52, "use" should read --uses--; and "which" should read --which is--.

COLUMN 18

Line 16, "on" should be deleted.

Signed and Sealed this

Eighteenth Day of August, 1998

Bruce Lehman

*Attest:*

BRUCE LEHMAN

*Attesting Officer*

*Commissioner of Patents and Trademarks*